US007206524B2

(12) United States Patent
Yokoe

(10) Patent No.: US 7,206,524 B2
(45) Date of Patent: Apr. 17, 2007

(54) IMAGE FORMING DEVICE AND IMAGE FORMING SYSTEM HAVING A REPLACEMENT UNIT MOUNTED THEREIN

(75) Inventor: Takeshi Yokoe, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 109 days.

(21) Appl. No.: 11/035,361

(22) Filed: Jan. 14, 2005

(65) Prior Publication Data

US 2005/0254833 A1 Nov. 17, 2005

(30) Foreign Application Priority Data

May 17, 2004 (JP) ..... 2004-146142
May 17, 2004 (JP) ..... 2004-146144

(51) Int. Cl.
*G03G 15/00* (2006.01)

(52) U.S. Cl. ..... 399/12

(58) Field of Classification Search ..... 399/12, 399/13, 24–27, 31, 44, 82, 85
See application file for complete search history.

(56) References Cited

FOREIGN PATENT DOCUMENTS

| | | |
|---|---|---|
| JP | A 06-149051 | 5/1994 |
| JP | B2 2602341 | 1/1997 |
| JP | A 10-133528 | 5/1998 |
| JP | A 2000-284581 | 10/2000 |
| JP | A 2001-100598 | 4/2001 |
| JP | B2 3476704 | 9/2003 |
| KR | A 2001-0067327 | 7/2001 |

*Primary Examiner*—Hoang Ngo
(74) *Attorney, Agent, or Firm*—Oliff & Berridge, PLC

(57) ABSTRACT

Where a toner cartridge other than a genuine product is mounted, the image forming device stops displaying information regarding the usage amount such as the residual amount of toner, etc., and causes the display/input device of the host device to display a screen including information regarding an operation mode and a toner cartridge other than a genuine product. In addition, the image forming device not only stops displaying the residual amount of toner, but also causes the display/input device of the host device to display a screen including information regarding the number of sheets of paper already printed, which is measured or metered from the mounting of a toner cartridge, and the printing coverage thereof.

22 Claims, 34 Drawing Sheets

FIG. 32A

Ready to Print

FIG. 32B

Ready to Print

Operation Mode 1: Toner X

FIG. 32C

Printing

FIG. 32D

Printing

Caution: Now operating in Operation Mode 1.
Although the image quality cannot be
guaranteed, prinitng is possible.
Toner X is not a genuine product.

IMAGE FORMING DEVICE AND IMAGE FORMING SYSTEM HAVING A REPLACEMENT UNIT MOUNTED THEREIN

BACKGROUND OF THE INVENTION

1. Field of the Invention

The present invention relates to an image forming device and an image forming system, and in particular those having a replacement unit mounted therein.

2. Background Art

There are known image forming devices, with which consumables and other units can be replaced at a user's option.

Meanwhile, when a unit that is replaced by the user is a product other than a genuine product for the image forming device, problems, such as a lowering of the image quality and other cases of inadequate exhibition of the performance of the image forming device, the inability to guarantee operations, and malfunctions, etc., may occur. This is because an image forming device controls the image forming process in consideration of the characteristics of the toner, the characteristics of the image carrying body, the charging voltage, the cleaning characteristics, the fixing characteristics, etc.

For maintaining the image quality of an image forming device and preventing problems, JP-A-10-133528 discloses a method wherein a genuine replacement part is provided with a data carrier, which holds consumption amount data of a consumable, and whether or not the consumable has been supplied to the genuine replacement part is judged by comparing the consumption amount detected by a consumption amount detection part provided in a main device body and the consumption amount data held by the data carrier.

Also, JP-A-6-149051 discloses a method wherein a toner cartridge is provided with a storage unit that stores predetermined code data and copying is prohibited when the main body of a copier cannot read the predetermined code data from the storage unit.

Also, JP-A-2001-100598 discloses a method wherein, when empty information, which is written into a cartridge when the running out of toner is detected, is read from a cartridge to which toner has been replenished, a warning indication is displayed and printing is prohibited.

Also, Japanese Patent No. 2602341 discloses a method wherein the count of images prepared is stored in a memory of a cartridge and the cartridge is prevented from further use when a preset end count, which expresses the number of images that can be prepared by the cartridge, becomes equal to the count of the images prepared.

Furthermore, Japanese Patent No. 3476704 discloses a method wherein, when by bi-directional communication between a container side communication unit of a toner supplying container and a main body side communication unit of a main device body, it is judged that a toner supplying container that has been mounted is incompatible and it is selected by a selection inputting unit that a supplying process is to be continued with the incompatibility being ignored, image forming conditions that are lower in level than appropriate image forming conditions are set to enable the incompatibility of the toner supplying container to be discovered more readily.

SUMMARY OF THE INVENTION

It is a first object of the invention to provide an image forming device and an image forming system which are capable of using, at a user's option, a replacement unit not being a genuine product even when a replacement unit other than a genuine replacement unit is mounted. Also, it is a second object of the invention to provide an image forming device and an image forming system which are capable of maintaining convenience and utility of a user even if a replacement unit which is other than a genuine product is mounted. Also, it is a third object of the invention to provide an image forming device and an image forming system which are capable of causing a user to correctly recognize, where a replacement unit other than a genuine replacement unit is mounted, that a replacement unit other than the genuine replacement unit is mounted.

In order to achieve the above-mentioned objects, a first aspect of the invention resides in an image forming device comprising a main device body; at least one replacement unit which is replaceably mounted in the main device body; a determining unit for determining whether or not the replacement unit is genuine or other than a genuine product; a inputting unit for selecting an operation mode corresponding to a genuine product and other operation modes differing from the first operation mode; a controlling unit for controlling image formation in an operation mode selected by the inputting unit; a displaying unit for displaying information regarding the usage amount of the replacement unit; and a display controlling unit for controlling a display pattern of information regarding the usage amount of the displaying unit in accordance with the results of determination made by the determining unit. That is, since a user is able to select an operation mode corresponding to a genuine replacement unit or other operation modes and is able to check information regarding the usage amount of a replacement unit in accordance with the replacement unit, the user can use a replacement unit other than a genuine product at a user's option while maintaining the convenience and utility.

Here, "operation mode" refers to the mode of control of the image forming device and this includes not only the program and control parameters for image formation but also includes input conditions and output conditions and furthermore modes of display on a display device that are not directly related to image formation.

Preferably, the display controlling unit stops displaying information regarding the usage amount of a replacement unit in the displaying unit where it is determined by the determining unit that the replacement unit is other than a genuine product. Therefore, a user is able to correctly use the replacement unit without erroneously recognizing information regarding the usage amount of the replacement unit even where the image forming device cannot correctly calculate information regarding the usage amount of the replacement unit.

Preferably, the displaying unit displays information regarding the usage amount measured and/or metered since the replacement unit has been replaced where it is determined by the determining unit that the replacement unit is other than a genuine product. Therefore, a user recognizes the using state of the replacement unit and can use it even where the replacement unit is other than a genuine product.

Preferably, the display controlling unit selects a display pattern from a plurality of display patterns. Therefore, a user is able to check information regarding the usage amount of a replacement unit in a display pattern suitable for the replacement unit.

Also, the second aspect of the invention resides in an image forming device comprising: a main device body; at least a replacement unit replaceably mounted in the main device body; a detecting unit for detecting that the replacement unit has been replaced; a determining unit for determining whether the replacement unit is genuine or other than a genuine product when it is detected by the detecting unit that the replacement unit has been replaced; an inputting unit for selecting an operation mode corresponding to a genuine replacement unit and other operation modes differing from the first operation mode; a controlling unit for carrying out control in an operation mode selected by the inputting unit; a displaying unit for displaying information regarding the usage amount of the replacement unit; and a display controlling unit for changing a display pattern of information regarding the usage amount of the displaying unit in accordance with the results of determination made by the determining unit. That is, where a replacement unit is replaced, it is determined whether the replacement unit is genuine or other than a genuine product, and a user selects an operation mode corresponding to a genuine replacement unit or another operation, and is able to check information regarding the usage amount of the replacement unit in a display pattern corresponding to the replacement unit, wherein it is possible for a user to use the replacement unit while maintaining convenience and utility.

Further, a third aspect of the invention resides in an image forming system comprising: an image forming device; and a host device connected to the image forming device; wherein the image forming device includes: a main device body; at least a replacement unit replaceably mounted in the main device body; a determining unit for determining whether the replacement unit is genuine or other than a genuine product; a controlling unit for carrying out control in an operation mode selected by the inputting unit; a display controlling unit for changing a display pattern of information regarding the usage amount of the displaying unit in accordance with the results of determination made by the determining unit; and wherein the host device includes: an inputting unit for selecting an operation mode corresponding to a genuine replacement unit and other operation modes differing from the first operation mode; and a displaying unit for displaying information regarding the usage amount of the replacement unit. Therefore, a user selects an operation mode corresponding to a genuine replacement unit or another operation mode via the host device, and is able to check information regarding the usage amount of the replacement unit in a display pattern corresponding to the replacement unit. Even if a replacement unit other than a genuine product is mounted, it is possible to use a replacement unit other than a genuine product at a user's option while maintaining the convenience and utility.

Further, a fourth aspect of the invention resides in an image forming device comprising a main device body; at least one replacement unit which is replaceably mounted in the main device body; a determining unit for determining whether or not the replacement unit is genuine or other than a genuine product; a displaying unit for displaying guidance information where it is determined on the result of determination made by the determining unit that the replacement unit is other than a genuine product; an inputting unit for inputting to select an operation mode corresponding to the replacement unit which is genuine and another mode differing from the first operation mode; and a controlling unit for carrying out control in an operation mode selected by the inputting unit. That is, where a replacement unit other than a genuine replacement unit is mounted, a user is able to select an operation mode corresponding to a genuine replacement unit or other operation modes while checking guidance information display, to correctly recognize a mounted replacement unit, and to use a replacement unit other than a genuine replacement unit at a user's option.

Also, herein, the operation mode means a control mode of an image forming device, which includes not only programs and control parameters for forming images but also input conditions and output conditions, and image formation includes a display mode in a display unit which is not directly in relation to the system.

Preferably, where it is determined on the basis of the result of determination made by the determining unit that the replacement unit is other than a genuine product, the displaying unit displays that the replacement unit is other than a genuine product. Therefore, a user is able to recognize that, where a replacement unit which is other than a genuine replacement unit is mounted, the replacement unit is other than the genuine replacement unit.

Also, preferably, where it is determined on the basis of the result of determination made by the determining unit that the replacement unit is other than a genuine product, the displaying unit displays that the controlling unit is caused to operate in another mode differing from the first operation mode. Therefore, where a replacement unit other than a genuine replacement unit is mounted, a user is able to recognize that the controlling unit is caused to operate in another mode.

Further, preferably, where the controlling unit operates in other operation modes differing from the first operation mode, the displaying unit displays that the image quality or performance may deteriorate in comparison with a case of operation in the first mode. Therefore, if a user uses a replacement unit other than a genuine replacement unit, a user is able to recognize that there are cases where the image quality or performance may deteriorate in comparison with a case where a genuine replacement unit is used.

In addition, preferably, the displaying unit displays that the controlling unit controls in other operation modes differing from the first operation mode. Therefore, a user is able to recognize that an image forming device is controlled in another mode differing from the first mode.

Also, preferably, where the controlling unit controls in another mode differing from the first operation mode, the displaying unit displays the replacement unit determined to be other than a genuine product. Therefore, a user is able to recognize that the image forming device is controlled in other operation modes differing from the first operation mode since a specified replacement unit is other than the genuine replacement unit.

Also, preferably, the inputting unit includes display/non-display selecting unit for selecting whether or not the displaying unit is caused to operate. Therefore, a user selects that a message displayed when the image forming device is controlled in another mode differing from the first operation mode is not displayed.

Further, preferably, an operation mode corresponding to a genuine replacement unit is set as a default. Therefore, where the replacement unit is genuine, the image forming device can be controlled in an operation mode corresponding to a genuine replacement unit without selecting the operation mode by a user.

Also, a fifth aspect of the invention resides in an image forming device comprising: a main device body; at least one replacement unit which is replaceably mounted in the main device body; a detecting unit for detecting that the replacement unit is replaced; a determining unit for determining whether, where the detecting unit detects that a replacement unit is replaced, the replacement unit is genuine or other than a genuine product; a displaying unit for displaying guidance information where it is determined on the basis of the result of determination made by the determining unit that the replacement unit is other than a genuine product; an inputting unit for inputting to select an operation mode corresponding to a replacement unit which is genuine and other operation modes differing from the first operation mode; and a controlling unit for carrying out control in an operation mode selected by the inputting unit. That is, where a replacement unit is replaced, it is determined whether the replacement unit is genuine or other than a genuine replacement unit, and a user is able to select an operation mode corresponding to a genuine replacement unit or other operation modes while checking guidance information display where a replacement unit other than a genuine product is mounted.

Preferably, the inputting unit is capable of selecting an operation mode where no replacement of a replacement unit is detected by the detecting unit. That is, a user is able to select an operation mode while checking guidance information display where a replacement unit is not replaced.

Also, preferably, where the detecting unit detects that a replacement unit is replaced, the determining unit determines whether the replacement unit is genuine or other than a genuine product. Therefore, when a replacement unit is replaced, a user is able to select an operation mode while checking guidance information display, and where a replacement unit other than a genuine replacement unit is mounted, a user correctly recognizes the mounted replacement unit, and it is possible to use a replacement unit other than a genuine replacement unit at a user's option.

In addition, after the detecting unit detects that a replacement unit is replaced, the determining unit determines whether the replacement unit is genuine or other than a genuine product. Therefore, even in a case where it is not impossible for the determining unit to determine that the replacement unit is other than a genuine replacement unit when a replacement unit is replaced, it is possible for the determining unit to determine, after a specified period of time elapses, that the replacement unit is other than a genuine replacement unit. The user is able to select an operation mode while checking guidance information display.

Also, a sixth aspect of the invention resides in an image forming system comprising an image forming device and a host device connected to the image forming device; wherein the image forming device includes: a main device body; at least one replacement unit which is replaceably mounted in the main device body; a determining unit for determining whether the replacement unit is genuine or other than a genuine product; and a controlling unit for carrying out control in an operation mode selected by an inputting unit; and wherein the host device includes: a displaying unit for displaying guidance information where it is determined on the basis of determination made by the determining unit that the replacement unit is other than a genuine product; and an inputting unit for inputting to select an operation mode corresponding to a replacement unit which is genuine or other operation modes differing from the first operation mode. Accordingly, where a replacement unit other than a genuine replacement unit is mounted, while checking guidance information display via the host device, users can select an operation mode corresponding to a replacement unit which is genuine or other operation modes differing from the first operation mode, therefore, users can correctly recognize the replacement unit which is mounted and use the replacement unit other than a genuine product at a user's option.

According to the present invention, it is possible to use a replacement unit, which is other than a genuine product, at a user's option while maintaining the convenience of a user even if a replacement other than a genuine product is mounted. In addition, according to the invention, even if a replacement unit other than a genuine product is mounted, convenience of the user can be maintained. Also, according to the invention, if a replacement unit other than a genuine replacement unit is mounted, a user is able to correctly recognize that a replacement unit other than a genuine replacement unit is mounted.

BRIEF DESCRIPTION OF THE DRAWINGS

These and other objects and advantages of this invention will become more fully apparent from the following detailed description taken with the accompanying drawings in which:

FIGS. 16A and 16B are graphs showing the results compensated by the setting shown in FIG. 15, wherein FIG. 16A shows the compensated toner density and FIG. 16B is a graph showing the compensated image density;

FIGS. 24A and 24B are views showing screens displayed in the UI device, wherein FIG. 24A is a screen for accepting an input for a user to select the operation mode corresponding to a genuine product, and FIG. 24B is a screen for accepting an input for a user to select an operation mode with respect to a toner cartridge other than a genuine product;

FIGS. 26A and 26B are views showing a screen for the host device 3 to display information regarding the usage amount of a toner cartridge 52 in the display/input device 410 while the image forming device 10 is in printing, wherein FIG. 26A is a screen displayed where the image forming device 10 is controlled in the operation mode corresponding to a genuine product, and FIG. 26B is a screen displayed where the image forming device 10 is controlled in an operation mode differing from the operation mode corresponding to a genuine product;

FIGS. 27A and 27B are views showing screens for the host device 3 to display information regarding the usage amount of a toner cartridge 52 in the display/input device 410 when the image forming device 10 is in printing or is waiting, wherein FIG. 27A is a screen displayed where the image forming device 10 is controlled in the operation mode corresponding to a genuine product during waiting, and FIG. 27B is a screen displayed when printing where the image forming device 10 is controlled in an operation mode differing from the operation mode corresponding to a genuine product;

FIGS. 30A and 30B are views showing screens displayed in the UI device, wherein FIG. 30A is a screen for accepting an input to commence selection of operation modes or selection of displaying methods, and FIG. 30B is a screen for accepting an input of selecting an operation mode with respect to a genuine cartridge by a user;

FIGS. 31A to 31C are views showing screens displayed in the UI device where it is determined that a replacement unit is other than a genuine cartridge, wherein FIG. 31A is a screen displayed where a replacement unit other than a genuine cartridge is detected, FIG. 31B is a screen for accepting an input of confirmation of an operation continued by a user, and FIG. 31C is a screen for accepting an input of selecting an operation mode differing from the operation mode corresponding to a genuine cartridge by a user;

FIGS. 32A to 32D are views showing a screen displayed in the UI device or the display/input unit where the image forming device 10 is in a printing-available state or a printing state;

DETAILED DESCRIPTION OF THE PREFERRED EMBODIMENTS

First Embodiment

A description is given of an embodiment of the invention based on the drawings.

Figure 1:
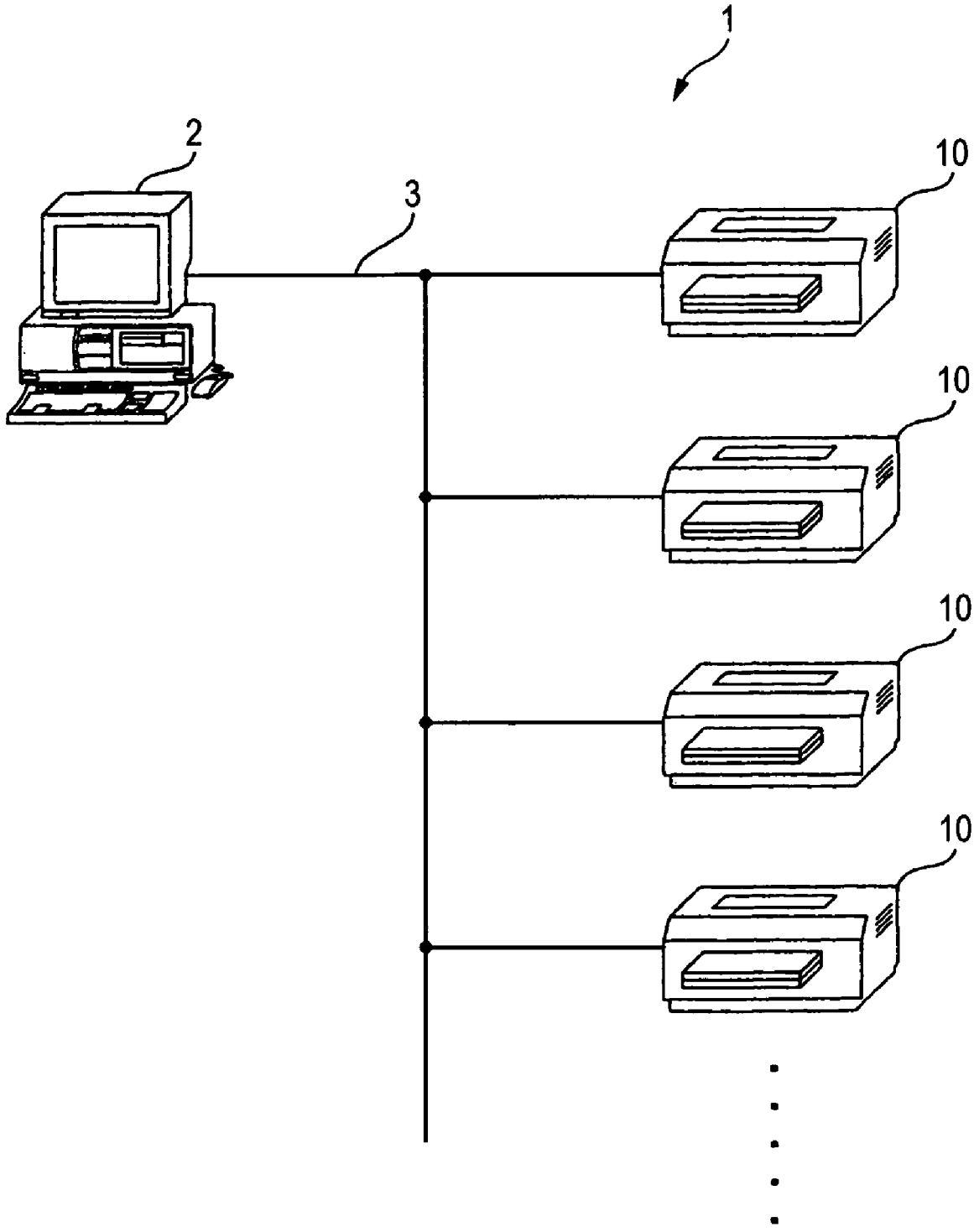
FIG. 1 is a schematic diagram of an image forming system of an embodiment according to the invention.

FIG. 1 shows an image forming system 1 of an embodiment according to the invention. The image forming system 1 is arranged by a PC (Personal Computer) or other host device 2 being connected, for example, to a plurality of image forming devices 10 via a network 3. The host device 2 may, for example, be a control device, such as an MCU (Micro Controller Unit), etc., an input/output device, such as a touch panel, or a terminal besides a PC, which has a communication device for sending and receiving signals via the network 3. The network 3 may be wired or wireless. Also, a plurality of host devices 2 maybe connected to the network 3.

The image forming system 1 is thus arranged so that the host device 2 can control the image forming devices 10 via the network 3.

Figure 2:
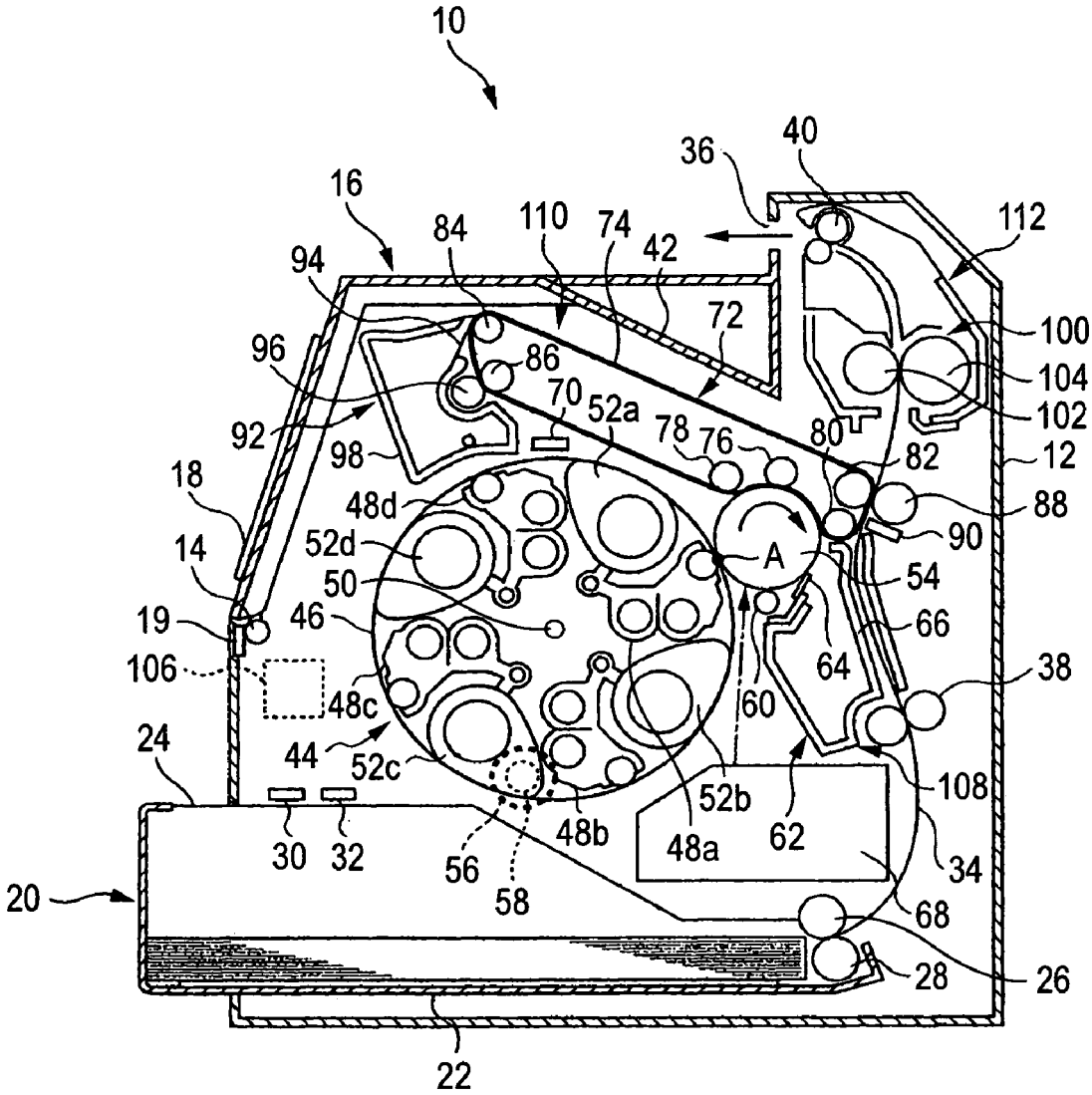
FIG. 2 is a side view showing an outline of an image forming device of an embodiment according to the invention.

FIG. 2 shows an image forming device 10 in outline. The image forming device 10 has an image forming device main body 12, and an opening/closing cover 16, which is rotatable about a rotation pivot 14, is provided on an upper part of the image forming device main body 12. A user interface (UI device) 18, which, for example, is a touch panel, etc., is provided on the front face side (left side in FIG. 2) of the opening/closing cover 16. The UI device 18 displays control information, instruction information, etc., of the image forming device 10 and accepts instruction information and other inputs provided by a user. That is, the user can operate the image forming device 10 via the UI device 18. The UI device 18 may be a device that just accepts the inputs of switches, etc., or may be a device that just outputs indications, etc., or may be a device that combines the respective functions.

Also in the vicinity of rotation pivot 14 is provided an opening/closing detection sensor 19, which detects the opening/closing of opening/closing cover 16, for example, by contacting/separating in accordance with the opening/closing of opening/closing cover 16.

A paper feed unit 20, for example, of a single stage, is positioned at a lower part of the image forming device main body 12. The paper feed unit 20 has a paper feed unit main body 22 and a paper feed cassette 24 in which paper sheets are housed. At an upper part near the inner end of the paper feed cassette 24 are positioned a feed roll 26, which supplies paper from paper feed cassette 24, and a retard roll 28, which separates the supplied paper one sheet at a time. Also, above the paper feed cassette 24 are provided a temperature sensor 30, which detects the temperature inside the image forming device main body 12, and a humidity sensor 32, which detects the humidity inside the image forming device main body 12.

A conveying path 34 is a passage for the paper from feed roll 26 to an ejection opening 36, and the conveying path 34 is formed substantially vertically from the paper feed unit 20 to a fixing device 100, which shall be described later and is positioned near the rear side (right side face in FIG. 2) of the image forming device main body 12. A secondary transfer roll 88 and a secondary transfer backup roll 82, to be described later, are positioned at the upstream side of fixing device 100 of the conveying path 34, and resist roll 38 is positioned at the upstream side of the secondary transfer roll 88 and secondary transfer backup roll 82. An ejection roll 40 is positioned near the ejection opening 36 of the conveying path 34.

Paper sheets, which are fed by the feed roll 26 from the paper feed cassette 24 of the paper feed unit 20, are thus separated by the retard roll 28 so that just the topmost paper sheet is guided to the conveying path 34, stopped temporarily by the resist roll 38, subject to the transfer of atoner image by being passed, at an adjusted timing, between the secondary transfer roll 88 and the secondary transfer backup roll 82 to be described later, subject to fixing of the transferred toner image by the fixing device 100, and ejected by the ejection roll 40 from the ejection opening 36 onto an ejection part 42, provided at an upper part of the opening/closing cover 16. The ejection part 42 is inclined so as to be low at the ejection opening portion and to become gradually higher in the direction of the front face (left direction in FIG. 2).

A rotary developing device or other developing device unit 44 is positioned, for example, at a substantially central part of the image forming device main body 12. The developing device unit 44 has a developing device unit main body 46, and four developing devices 48*a* to 48*d*, which form toner images, are mounted to the developing device unit main body 46. The developing devices 48*a* to 48*d* rotate, along with the developing device unit main body 46, left-handedly (counterclockwise in FIG. 2) about a rotation shaft 50. Cylindrical toner cartridges 52*a* to 52*d*, containing yellow (Y), magenta (M), cyan (C), and black (K) toners, are mounted to the developing devices 48*a* to 48*d*, respectively. When the toner cartridges 52*a* to 52*d* are mounted via the developing devices 48*a* to 48*d* on to the developing device unit main body 46, the outer surfaces thereof are made substantially flush with the outer circumference of the developing device unit main body 46.

An image carrying body 54, comprising, for example, a photoconductor, is positioned so as to contact the developing device unit 44 from the back face side (right side in FIG. 2) of the image forming device 10. That is, with the developing device unit 44, the four colors of Y, M, C, and K for full-color developing are prepared, and the developing devices 48*a* to 48*d* are respectively moved rotatingly and positioned at a position opposing the image carrying body 54 to successively develop a latent image on the image carrying body 54, one color at a time with the yellow (Y), magenta (M), cyan (C), and black (K) toners.

Also, near a position substantially opposite the image carrying body 54 across the rotation shaft 50 of the developing device unit 44 is positioned a wireless communications unit 56. The wireless communications unit 56 has an antenna 58 and performs wireless communications with a memory chip 170 to be described later.

Below the image carrying body 54 is provided a charging device 60, comprising, for example, a charging roll that uniformly charges the image carrying body 54. Also, an image carrying body cleaner 62 is put in contact with the image carrying body 54 at the upstream side of the charging device 60 in the rotation direction. An image carrying body cleaner 62 comprises, for example, a cleaning blade 64, which scrapes off the toner that remains on the image carrying body 54 after primary transfer, and a waste toner recovery bottle 66, which recovers the toner that is scraped off by the cleaning blade 64.

The back face side (right side in FIG. 2) of waste toner recovery bottle 66 has, for example, ribs, etc., formed thereon and is thereby formed into a curved surface so as to form a part of the conveying path 34 that enables paper to be conveyed smoothly.

Below the back face side of the developing device unit 44 is positioned an exposure device 68, which writes a latent image by means of laser light or other light ray onto the image carrying body 54, which has been charged by the charging device 60. Also, above the developing device unit 44 is positioned a non-use detection sensor 70, which, for example, is a reflection type photosensor, etc., and detects whether the toner cartridges 52*a* to 52*d*, mounted to the developing device unit 44, have not been used or have been used. Above the developing device unit 44 and non-use detection sensor 70 is provided an intermediate transfer device 72, which subjects the above-mentioned toner image, visualized by the developing device unit 44, to primary transfer one color at a time at a primary transfer position on each turn of an intermediate transfer body 74, and after thereby overlapping the toner images of four colors onto the intermediate transfer body 74, performs batch transfer onto a paper sheet at a secondary transfer position to be described later.

The intermediate transfer device 72 comprises, for example, an intermediate transfer belt or other intermediate transfer body 74, a primary transfer roll 76, a wrap-in roll 78, a wrap-out roll 80, secondary transfer backup roll 82, a scraper backup roll 84, and a brush backup roll 86. The intermediate transfer body 74, for example, has elasticity and is spanned substantially flatly above the developing device unit 44 so as to have long sides and short sides. The long side at the upper face side of the intermediate transfer body 74 is, for example, spanned so as to be substantially parallel with respect to the ejection part 42 provided at the upper part of the image forming device main body 12. Also, the intermediate transfer body 74 has a primary transfer part (image carrying body wrapping region), which contacts image carrying body 54 in a wrapping manner between the wrap-in roll 78, positioned at the long side at the lower face side and at the upstream side of primary transfer roll 76, and the wrap-out roll 80, positioned at the downstream side of primary transfer roll 76, and is thereby wound across just a predetermined range of the image carrying body 54 and follows the rotation of the image carrying body 54.

Furthermore, at the rear side (right side face in FIG. 2) of the intermediate transfer body 74, a flat part (short side) is formed by the wrap-out roll 80 and secondary transfer backup roll 82, and the flat part serves as a secondary transfer part that faces the conveying path 34.

The toner images on the image carrying body 54 are thus primary transferred overlappingly in order, for example, of yellow, magenta, cyan, and black by the primary transfer roll 76 onto the intermediate transfer body 74, which then conveys the primary transferred toner image towards the secondary transfer part.

The scraper backup roll 84 aids the scraping off of the toner remaining on the intermediate transfer body 74 by a scraper 94, to be described later, after secondary transfer, and the brush backup roll 86 aids the scraping off of the toner remaining on the intermediate transfer body 74 by a brush roll 96, to be described later, after the secondary transfer.

The secondary transfer roll 88 opposes the secondary transfer backup roll 82 of the intermediate transfer device 72 across the conveying path 34. The interval between the secondary transfer roll 88 and the secondary transfer backup roll 82 is thus the secondary transfer position in the secondary transfer part, and by being aided by the secondary transfer backup roll 82, the secondary transfer roll 88 performs secondary transfer of the toner image that has been primary transferred onto the intermediate transfer body 74 onto a sheet of paper at the secondary transfer position. Here, the secondary transfer roll 88 is arranged to be separated from the intermediate transfer body 74 while the intermediate transfer body 74 turns three times, that is, while the toner images of the three colors of yellow, magenta, and cyan are being conveyed, and come in contact with the intermediate transfer body 74 when the black toner image is transferred. A predetermined potential difference is made to arise across the secondary transfer roll 88 and secondary transfer backup roll 82 and, for example, in the case where the secondary transfer roll 88 is set to a high voltage, the secondary transfer backup roll 82 is connected to the ground (GND), etc.

At the upstream side of the secondary transfer position, an image density sensor 90, which, for example, is a reflection type photosensor, etc., is positioned so as to oppose the intermediate transfer body 74 across the conveying path 34. An image density sensor 90 reads a toner patch that is formed on the intermediate transfer body 74 to detect the density of the image formed on the intermediate transfer body 74.

At the end of the side opposite the image carrying body side of the intermediate transfer body 74, an intermediate transfer body cleaner 92 is disposed in a contacting manner. The intermediate transfer body cleaner 92 comprises, for example, scraper 94, which scrapes off the residual toner and cleans the secondary transfer body 74 after the secondary transfer, brush roll 96, which further scrapes off the toner remaining after cleaning by the scraper 94, and a waste toner recovery bottle 98, which recovers the toner scraped off by the scraper 94 and brush roll 96. The scraper 94 is, for example, formed of a thin stainless-steel plate and has applied thereto a voltage of polarity opposite that of the toner. Brush roll 96 comprises, for example, a brush formed of acrylic, to which a conductive treatment has been applied. The scraper 94 and brush roll 96 are separated from the intermediate transfer body 74 while the intermediate transfer body 74 conveys the toner images, and are arranged to contact the intermediate transfer body 74 integrally at a predetermined timing.

A fixing device 100 is positioned above the secondary transfer position. The fixing device 100 has a heating roll 102 and a pressing roll 104, fixes the toner image, which was secondary transferred onto a paper sheet by the secondary transfer roll 88 and secondary transfer backup roll 82, onto the paper sheet, and conveys the paper sheet toward the ejection roll 40.

Also, inside the image forming device main body 12 is positioned a control unit 106, which controls the respective parts that make up the image forming device 10.

An image carrying body unit 108 integrates the image carrying body 54, charging device 60, and image carrying body cleaner 62. Furthermore, an image forming unit 110 integrates the image carrying body unit 108, intermediate transfer device 72, and intermediate transfer cleaner 92. Also, a fixing unit 112 integrates the fixing device 100 and ejection roll 40.

Figure 3:
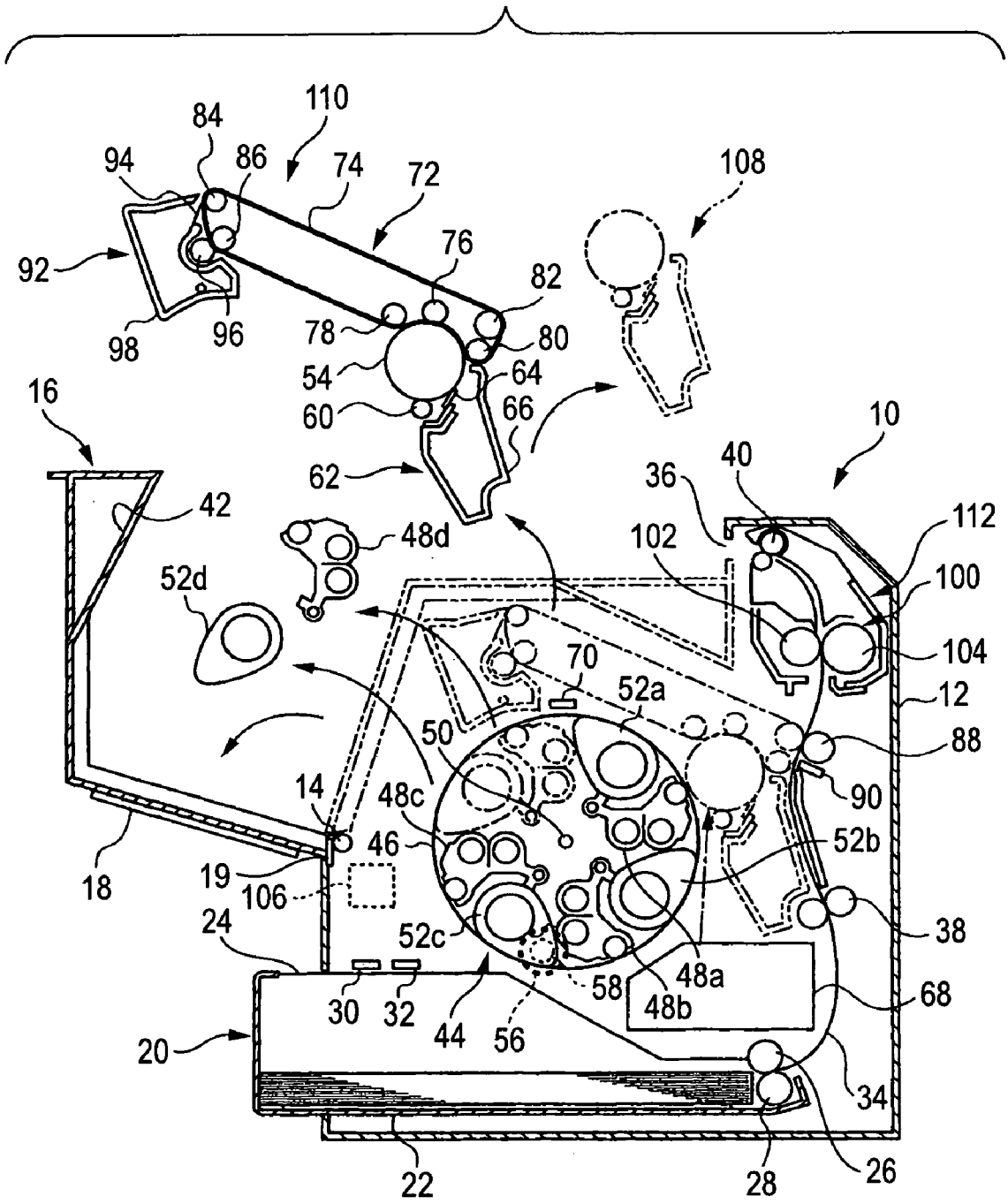
FIG. 3 is a side view showing, as an example, a state in which replaceable units of the image forming device of an embodiment according to the invention are detached from the main body of an image forming device.

As shown in FIG. 3, the image forming unit 110 is made detachable with respect to the image forming device main body 12 and can be attached or detached by opening the opening/closing cover 16. Also, the image carrying body unit 108 is made detachable with respect to the image forming unit 110.

The toner cartridges 52*a* to 52*d* are made detachable with respect to the developing devices 48*a* to 48*d*, mounted to the developing device unit main body 46, when being positioned at the front face side (opening/closing cover 16 side) with the opening/closing cover 16 being opened. The developing devices 48*a* to 48*d* are made detachable with respect to the developing device unit main body 46 when positioned at the front face side (opening/closing cover 16 side) with the opening/closing cover 16 being opened.

A fixing unit 112 is made detachable with respect to the image forming device main body 12 upon removal of an unillustrated upper cover. Other units, such as the developing device unit 44 and paper feed unit 20 are also made detachable with respect to the image forming device main body 12.

The respective units are thus enabled to be replaced by a user. Meanwhile, when in the case where a user mounts a replaceable unit onto the image forming device 10, a product other than a genuine product for the image forming device 10 is mounted, a problem, such as not being able to maintain satisfactory image quality, not being able to guarantee operation, etc., may occur. This is because the image forming device 10 is controlled in accordance with the characteristics of the members used in the image forming device 10. Sensors for detecting predetermined conditions, etc., are thus provided in a unit, etc., that is replaceable by a user.

In the following, in indicating a component, among components that are provided in plurality, such as the developing devices 48*a* to 48*d*, etc., without specifying which of those components in particular, the component may be referred to simply in an abbreviated form, such as "developing device 48."

An example of a replaceable unit, having sensors for determining predetermined conditions, etc., shall now be described.

Figure 4:
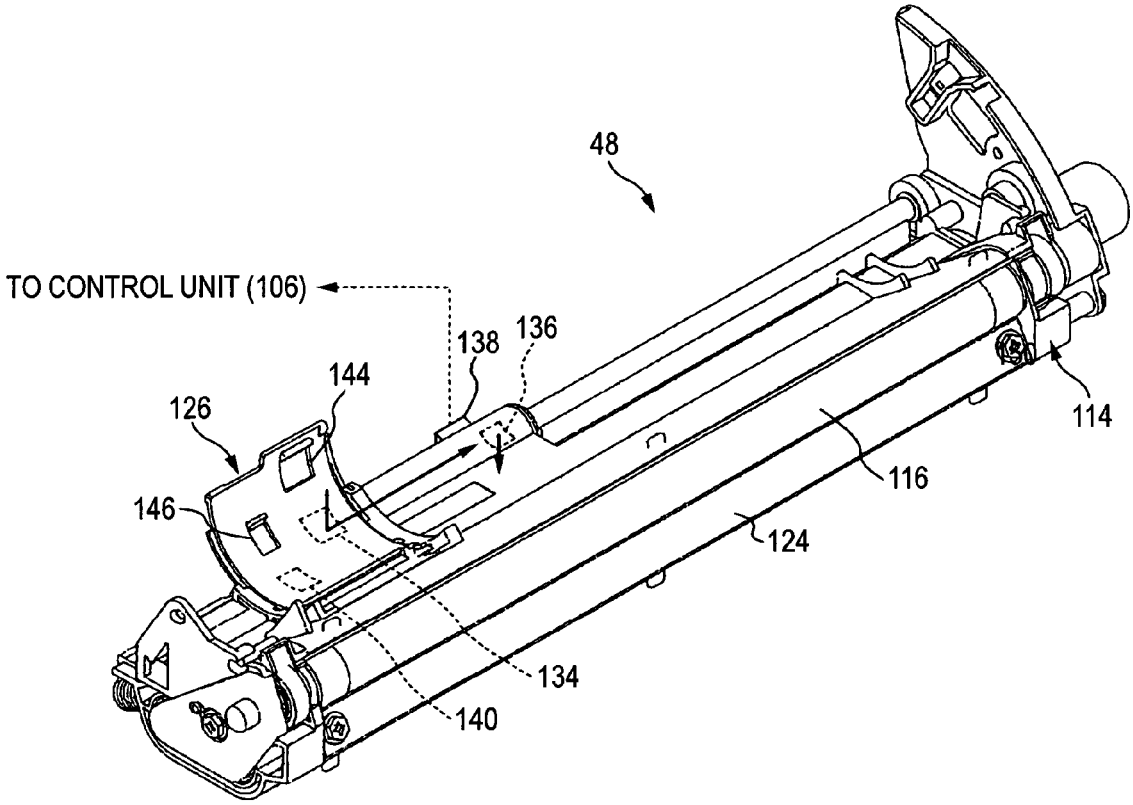
FIG. 4 is a perspective view showing a developing device of the image forming device of an embodiment according to the invention.
Figure 5:
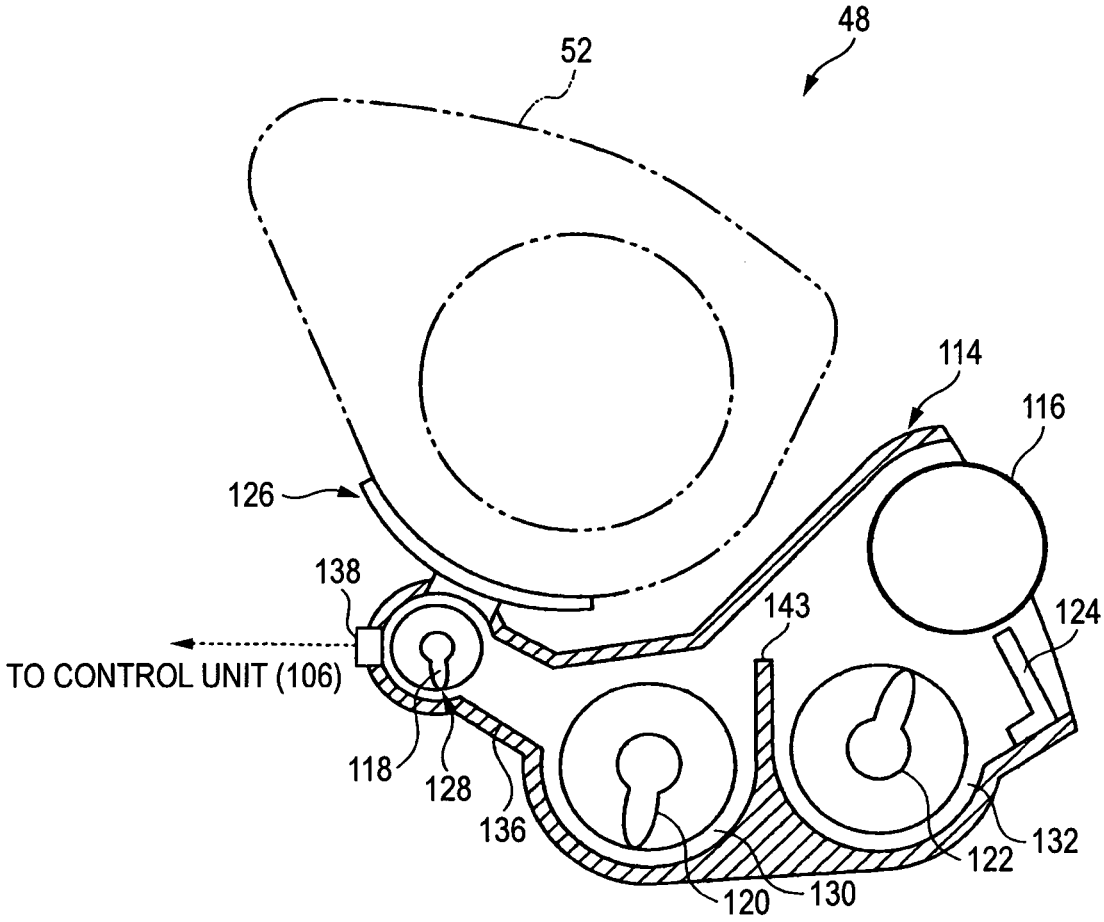
FIG. 5 is a schematic view showing a cross section of the developing device of the image forming device of an embodiment according to the invention.

FIG. 4 and FIG. 5 show the arrangement of a developing device 48, which is a replaceable unit.

The developing device 48 has a developing roll 116, which serves as a developing agent carrying body and is positioned at the image carrying body 54 side of a developing device housing (developing device main body) 114, a first auger 118, a second auger 120, a third auger 122, and a layer thickness restricting member 124 and contains, for example, a two-component developing agent comprising a nonmagnetic toner and magnetic toner.

The developing device housing 114 has a shutter 126, which opens and closes a toner receiving port 134 and a developing agent discharging port 140 to be described later, a cylindrical intake conveying path 128, for conveying of the toner taken in from a toner cartridge 52, and cylindrical developing agent conveying paths 130 and 132, for stirringly conveying the toner and the carrier.

An intake conveying path 128 has a toner receiving port 134, which receives the toner from the toner cartridge 52, and a toner feed port 136, which feeds toner into the developing agent conveying path 130, and the first auger 118 is disposed inside the intake conveying path 128. The first auger 118 conveys the toner received by the intake conveying path 128 from the toner cartridge 52 to the developing agent conveying path 130. Also, by adjustment of the rotation of the first auger 118, the amount of toner supplied from the toner cartridge 52 to the developing device 48 is adjusted. The toner concentration (ratio of the toner to carrier) and the toner charging amount of the developing agent are thereby controlled at predetermined values.

The toner usage amount (usage amount of the toner cartridge 52) may also be arranged to be computed by a CPU 202 by accumulating the driving time or number of rotations of the first auger 118. The toner usage amount may also be arranged to be computed by accumulating the current, which flows when the exposure device 68 writes an electrostatic latent image on the image carrying body 54, in the form of charges in a capacitor, etc., and by the CPU 202 counting the number of times the accumulated charges have reached a predetermined amount.

In the intake conveying path 128, a toner detection sensor 138 is provided between the toner receiving port 134 and the toner feeding port 136, and the toner detection sensor 138 detects whether or not toner exists in the intake conveying path 128 by detecting, for example, the variation of resistance, across two points inside the intake conveying path 128, due to the existence or non-existence of toner. The toner detection sensor 138 may be a piezoelectric element instead.

The developing agent conveying path 130 has a developing agent discharge port 140, through which an excessive developing agent is discharged into the toner cartridge 52, and the second auger 120 is positioned inside the developing agent conveying path 130. The second auger 120 stirringly mixes the toner and carrier, conveyed via the intake conveying path 128, and conveys the mixture to the developing agent conveying path 132.

The third auger 122 is positioned inside the developing agent conveying path 132. The third auger 122 stirringly conveys the developing agent conveyed via the developing agent conveying path 130 and supplies the developing agent to the developing roll 116.

A partition plate 143 is disposed between the developing agent conveying path 130 and the developing agent conveying path 132, and at the respective ends of partition plate 143 are provided passages (not illustrated) that connect the developing agent conveying path 130 with the developing agent conveying path 132. Thus, by the second auger 120 and third auger 122 conveying the developing agent in alternate directions, the toner is made to become friction-charged to a charging amount of a predetermined polarity by the carrier and circulate inside the developing device housing 114. Also, by a degraded developing agent being discharged at a predetermined timing from the developing agent discharge port 140 into the toner cartridge 52, the total life of the developing agent is extended (trickle development system).

The shutter 126 has openings 144 and 146, and by the opening 144 being overlapped with the toner receiving port 134, a toner passage from the toner cartridge 52 to the developing device 48 is formed, and by the opening 146 being overlapped with the developing agent discharge port 140, a passage for an excessive developing agent from the developing device 48 to the toner cartridge 52 is formed.

The developing roll 116 carries the toner and contacts the image carrying body 54 to develop the electrostatic latent image carried on the image carrying body 54 by the toner. The layer thickness restricting member 124 restricts the layer thickness of the toner carried on the developing roll 116.

Figure 6:
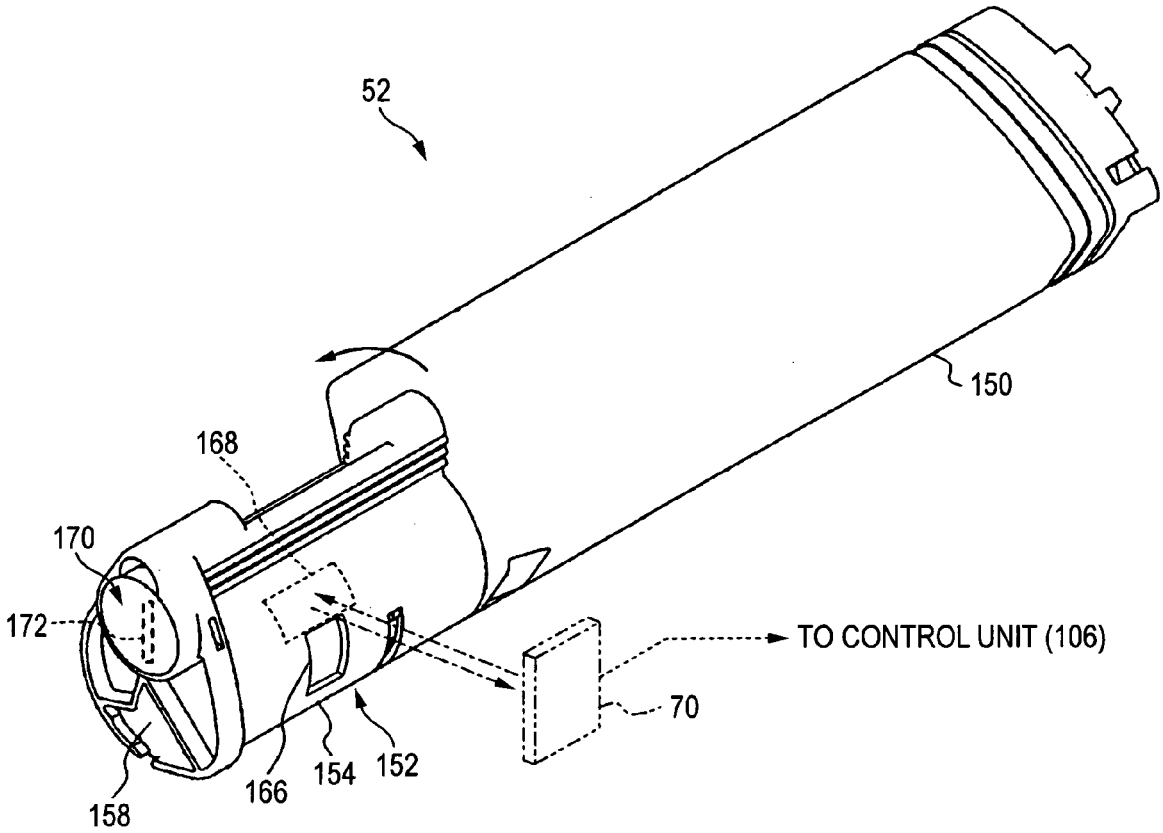
FIG. 6 is a perspective view showing a toner cartridge of the image forming device of an embodiment according to the invention.
Figure 7:
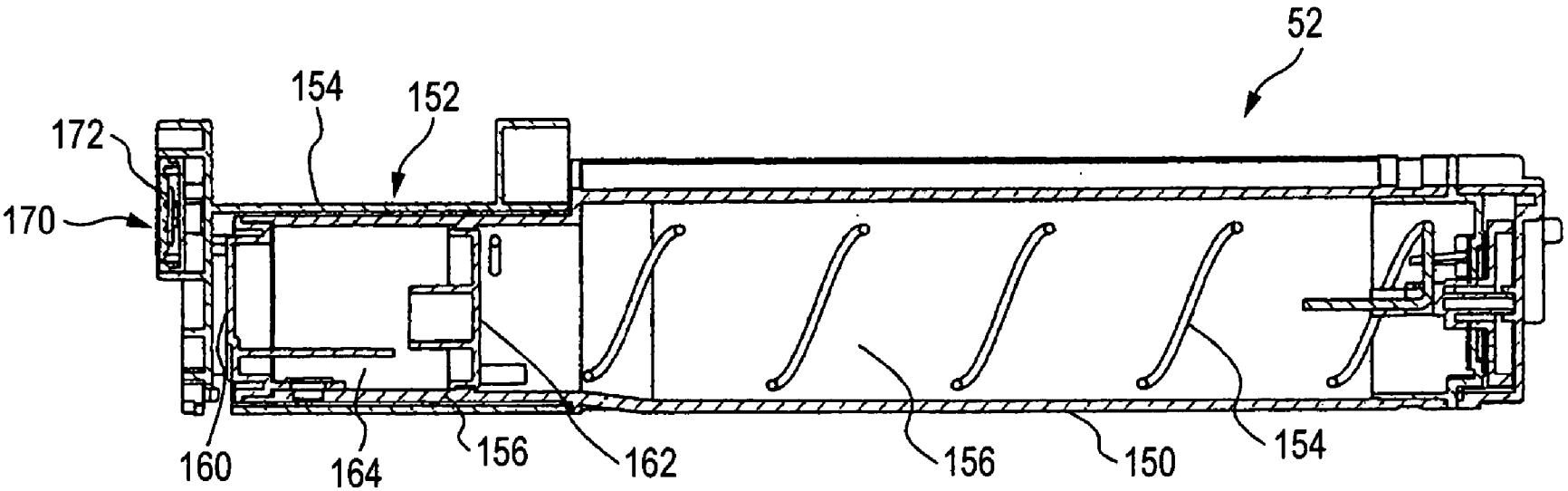
FIG. 7 is a sectional view showing the toner cartridge of the image forming device of an embodiment according to the invention.

FIG. 6 and FIG. 7 show the arrangement of a toner cartridge 52, which is a replaceable unit.

The toner cartridge 52 has a toner cartridge main body 150 and a rotating part 152, which is disposed at one end in the longitudinal direction of a toner cartridge main body 150.

The toner cartridge main body 150 is formed into a tubular shape and is formed so that a substantially cylindrical portion, in the interior of which a stirring conveying member 154 is positioned, is made integral to a gradually narrowing portion that extends in a direction substantially perpendicular to the longitudinal direction from the substantially cylindrical portion. The toner cartridge main body 150 is also arranged so that its outer surface will be substantially flush with the outer periphery of the developing device unit main body 46 when the toner cartridge 52 is mounted via the developing device 48 onto the developing device unit main body 46.

A toner-containing space 156, which contains the toner that is to be supplied to the developing device 48, is formed inside the toner cartridge main body 150. The above-mentioned stirring conveying member 154 is disposed in the toner-containing space 156. The stirring conveying member 154 is, for example, wound in a spiraling manner and stirs the toner inside the toner-containing space 156 while conveying the toner towards toner receiving port 134 of the developing device 48.

The rotating part 152 has a rotating part main body 154 and a cylindrical tubular part 156, which is disposed inside the rotating part main body 154 and is formed integral to the toner cartridge main body 150. The tubular part 156 is sealed off at the side of a side face part 158 of the rotating part main body 154 by a tubular part side wall 160 and has an isolating wall 162 provided in its interior. At the tubular part side wall 160 side of the isolating wall 162 is formed a developing agent recovery space 164 for recovering an excessive developing agent from the developing device 48, and at the side opposite the tubular part side wall 160 side of the isolating wall 162, the above-mentioned toner-containing space 156 is formed in an extending manner.

The rotating part main body 154, having a window-like window part 166 covered by a transparent member, is formed into be cylindrical at its inner side and is arranged to rotate along the outer face of the cylindrical portion of tubular part 156. Also, a reflecting member 168, which, for example, is a white tape, etc., is attached to the outer face of the cylindrical portion of the tubular part 156, and when the toner cartridge 52 is mounted to the developing device 48 and rotating part main body 154, a reflecting member 168 is arranged to be exposed via a window part 166. Also, when the developing device unit 44, to which the toner cartridge 52 is mounted, rotates inside the image forming device main body 12, the exposed reflecting member 168 is arranged to pass through a position opposing the non-use detection sensor 70, which is fixed to the image forming device main body 12. As mentioned above, the non-use detection sensor 70 is, for example, a reflection type photosensor and, by detecting the reflection amount that varies due to the soiling of the reflecting member 168 by the toner as the reflecting member 168 of the toner cartridge 52, mounted to the developing device unit 44, passes through the position opposing the non-use detection sensor 70, detects whether or not the toner cartridge 52 is one that has not been used.

A memory chip 170 is attached to the side face part 158 of the rotating part main body 154. The memory chip 170 has an antenna 172 and performs wireless communications with the wireless communications unit 56 disposed at the image forming device main body 12 side.

Next, in regard to the wireless communications unit 56 and memory chip 170, the respective circuit arrangements and the communication carried out mutually between the two components shall be described.

Figure 8:
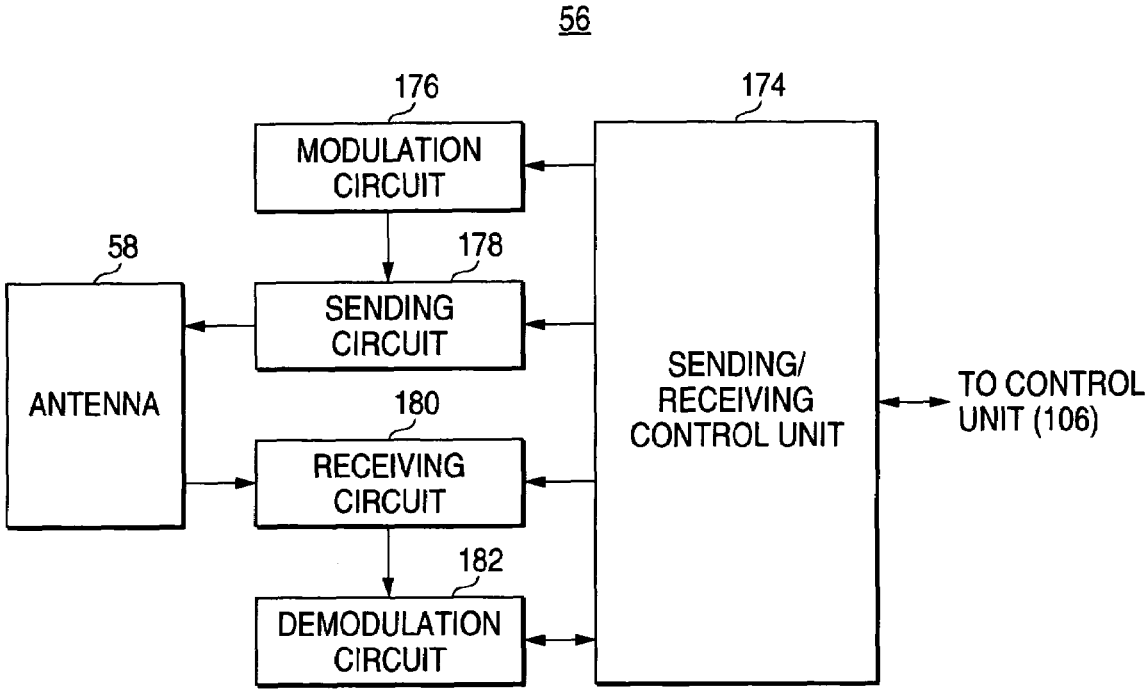
FIG. 8 is a block diagram showing the circuit arrangement of a wireless communications unit of the image forming device of an embodiment according to the invention.
Figure 9:
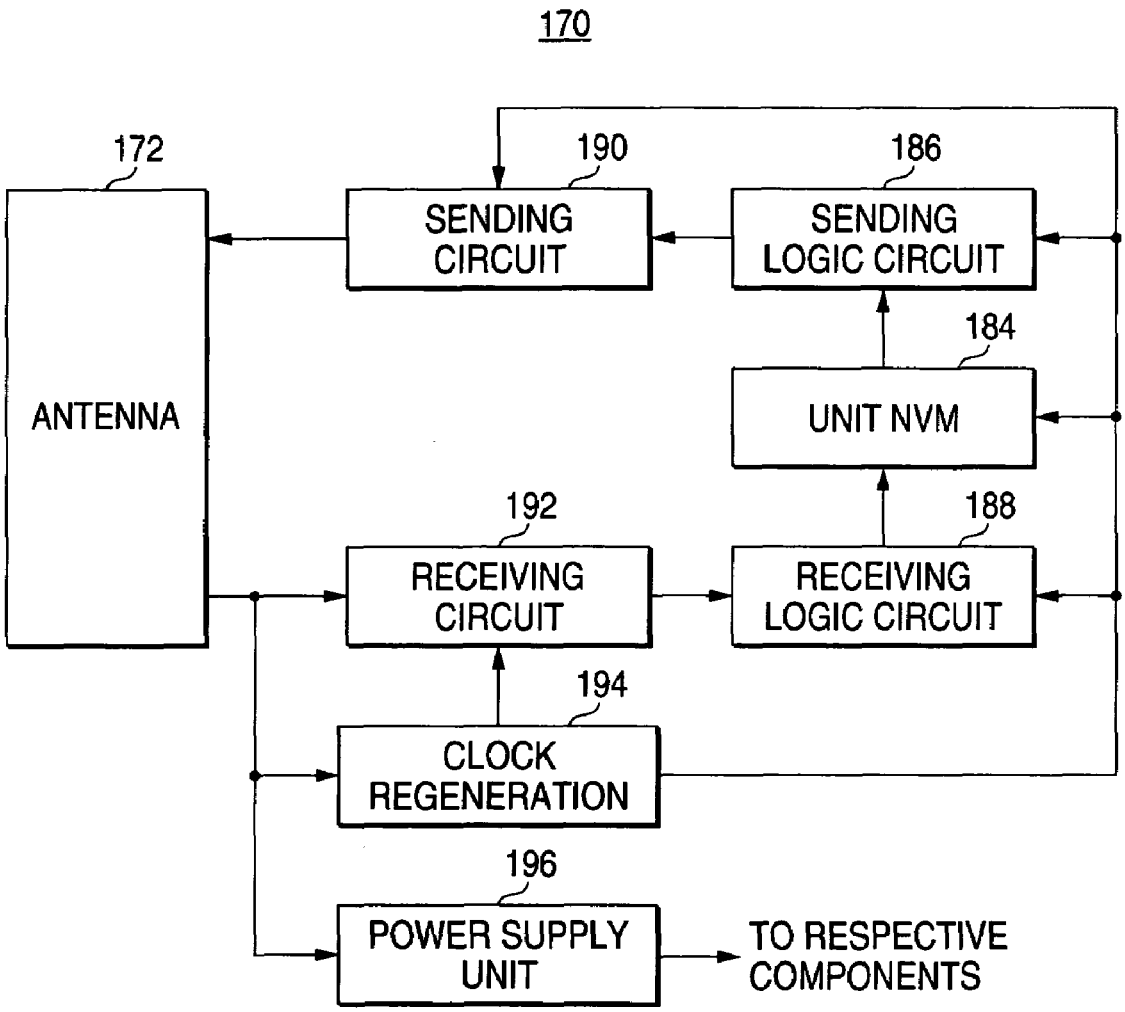
FIG. 9 is a block diagram showing the circuit arrangement of a memory chip of a toner cartridge used in the image forming device of an embodiment according to the invention.

FIG. 8 is a block diagram showing the circuit arrangement of the wireless communications unit 56. FIG. 9 is a block diagram showing the circuit arrangement of the memory chip 170.

As shown in FIG. 8, the circuit of the wireless communications unit 56 comprises a sending/receiving control unit 174, a modulation circuit 176, a sending circuit 178, a receiving circuit 180, a demodulation circuit 182, and an antenna 58. In the wireless communications unit 56, the sending/receiving control unit 174 controls the operations of the respective components of the wireless communications unit 56. The sending/receiving control unit 174 outputs data, inputted from the control unit 106, to the modulation circuit 176. Also, the sending/receiving control unit 174 outputs data, received by a receiving circuit 180 and demodulated by a demodulation circuit 182, to the control unit 106. The modulation circuit 176 modulates the data inputted from the sending/receiving control unit 174 and outputs the data to the sending circuit 178. The sending circuit 178 outputs radio signals, including data, clock signal, etc., to be stored in the memory chip 170, to the memory chip 170 via the antenna 58.

The receiving circuit 180 receives signals sent from the memory chip 170 via the antenna 58 and outputs the signals to the demodulation circuit 182. The demodulation circuit 182 demodulates the data sent from the memory chip 170 based on variations of the signals inputted from the receiving circuit 180 and outputs the data to the sending/receiving control unit 174.

As shown in FIG. 9, the circuit of the memory chip 170 comprises a unit NVM (Non Volatile Memory) 184, a sending logic circuit 182, a receiving logic circuit 188, a sending circuit 190, a receiving circuit 192, a clock regeneration circuit 194, a power supply unit 196, and an antenna 172.

When a radio signal is sent from the wireless communications unit 56 to the memory chip 170, the radio signal is received by a receiving circuit 192, a clock regeneration circuit 194, and a power supply unit 196 via the antenna 172. In the memory chip 170, upon receiving the radio signal, the power supply unit 196 rectifies the current resulting from electromagnetic induction due to the radio signal and supplies the respective components of the memory chip 170 with the power necessary for their operations. If for example, a voltage higher than the voltage generated by the power supply part 196 is required, the memory chip 170 may be arranged to receive power from the main body part 40. For example, a power supply coil, etc., may be provided further in the memory chip 170 and the power may be supplied in a non-contacting manner from the AC current supplied to the developing device unit 44.

Upon receiving the radio signal, the clock regeneration circuit 194 regenerates a clock signal and outputs the clock signal to the respective circuits that make up the memory chip 170. Upon receiving the radio signal, the receiving circuit 192 outputs the data or other signal contained in the radio signal to the receiving logic circuit 188 in synchronization with the clock signal inputted from the clock regeneration circuit 194. In synchronization with the clock signal inputted from the clock regeneration circuit 194, the receiving logic circuit 188 demodulates the data or other signal inputted from the receiving circuit and outputs the demodulated signal to the unit NVM 184.

The unit NVM 184 is a writable non-volatile memory and, in synchronization with the clock signal inputted from the clock regeneration circuit 194, performs the writing (storing) of data if the signal, inputted from the receiving logic circuit 188, indicates the writing of data, while if the signal indicates the reading of data, outputs the data stored in the unit NVM 184 to the sending logic circuit 186. The non-volatile memory contained in the unit NVM 184 may, for example, be a flash ROM, EEPROM, or FeRAM (ferroelectric memory).

In synchronization with the clock signal inputted from the clock regeneration circuit 194, the sending logic circuit 186 modulates the data inputted from the unit NVM 184 and outputs the modulated data to the sending circuit 190. In synchronization with the clock signal inputted from the clock regeneration circuit 194, the sending circuit 190 sends the signal inputted from the sending logic circuit 186 as a radio signal to the wireless communications unit 56 via the antenna 172.

The signals that are sent and received as radio signals may be arranged to be sent and received upon being coded and thereafter converted into radio signals. For example, arrangements may be made so that a permitted user, etc., can rewrite the contents of the unit NVM 184 from a device other than the control unit 106 using coded radio signals.

Figure 10:
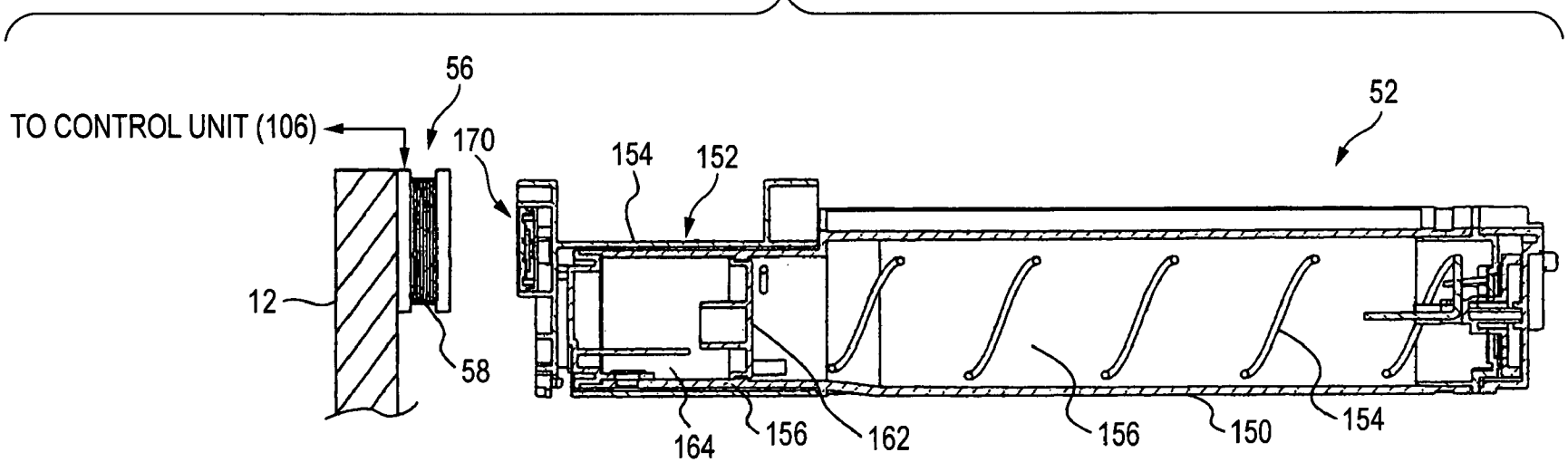
FIG. 10 is a sectional view showing the positional relationship of the wireless communications unit and a memory chip that perform wireless communications.

The positional relationship of the wireless communications unit 56 and memory chip 170, which perform wireless communications, is shown in FIG. 10. As described above, each toner cartridge 52 is mounted to a developing device 48 and is moved by the developing device unit 44 (FIG. 2) rotating about rotation shaft 50 as the axis. The wireless communications unit 56 is fixed to the image forming device main body 12 in the vicinity of the side of the developing device unit 44 so that each memory chip 170, which is moved by the rotation of the developing device unit 44, will oppose it successively, and is arranged to perform wireless communications in a state in which the movement of a developing device 48 is controlled and stopped at a substantially opposing position so as to enable wireless communications with a corresponding memory chip 170. Also, wireless communications unit 56 is arranged, for example, to receive an acknowledge signal, sent by the memory chip 170 in response to a radio signal output from the wireless communications unit 56, to confirm the start of sending and receiving of data.

Figure 11:
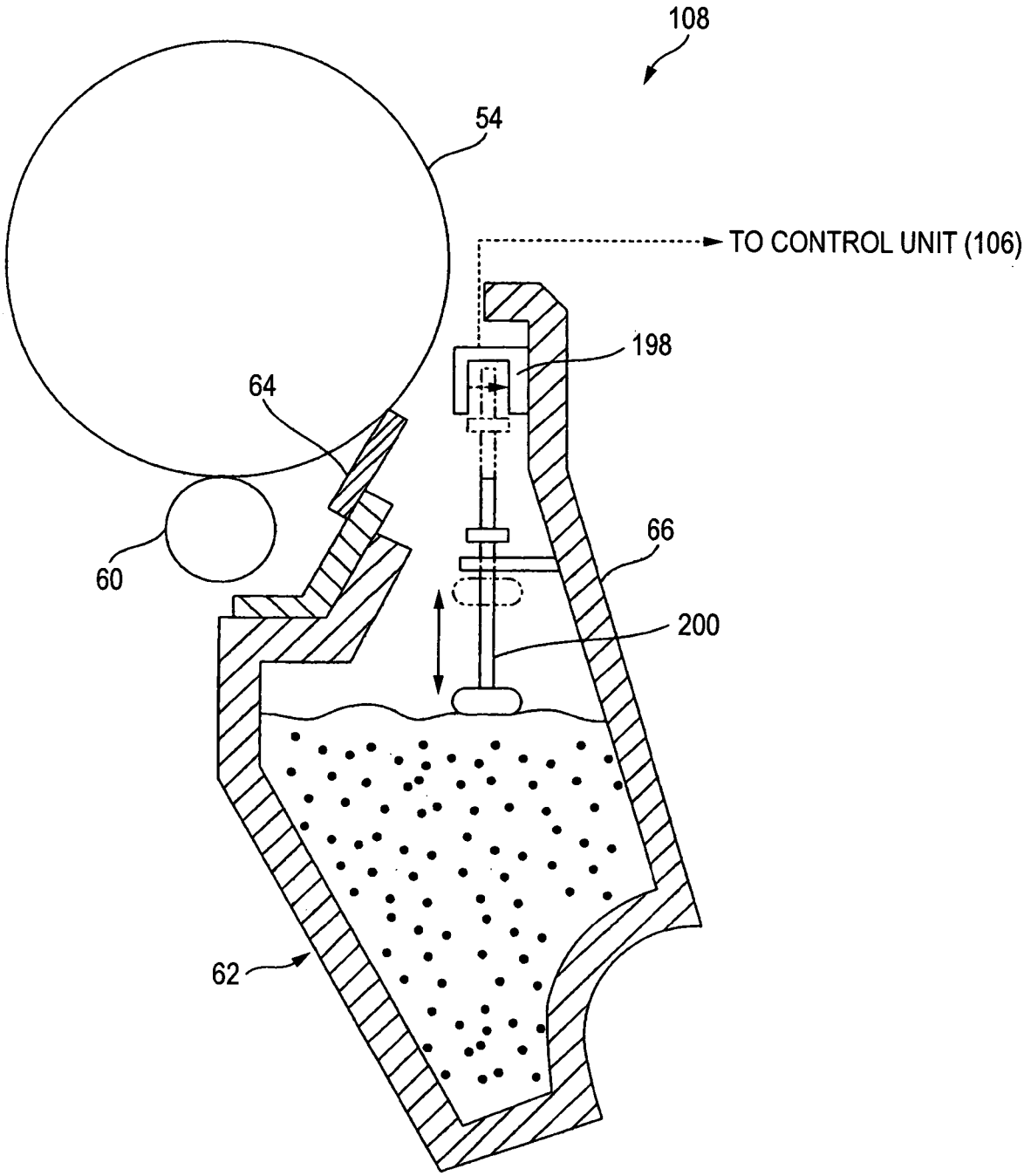
FIG. 11 is a side view showing the arrangement of an image carrying body unit used in the image forming device of an embodiment according to the invention.

FIG. 11 shows the arrangement of an image carrying body unit 108, which is a replaceable unit.

As mentioned above, the image carrying body unit 108 integrates the image carrying body 54, charging device 60, and image carrying body cleaner 62 and has a waste toner full sensor 198, disposed, for example, at an upper part of the interior of the image carrying body cleaner 62, and a float 200, disposed below the waste toner full sensor 198. The waste toner full sensor 198 has an optical path, wherein light emitted from a light emitting part disposed at one side is received by a light receiving part disposed at the other side, and outputs whether or not the light receiving part has received the light to the control unit 106. A float 200 is arranged to rise when the waste toner, recovered in the waste toner recovery bottle 66 from the image carrying body 54, exceeds a predetermined amount and is arranged to block the optical path of the waste toner full sensor 198 when the waste toner recovery bottle 66 becomes full with waste toner. The image carrying body unit 108 thus detects whether or not the waste toner recovery bottle 66 has become full by means of the waste toner full sensor 198 and float 200 and outputs the information to the control unit 106.

A waste toner full sensor 198 and a float 200 may also be provided at the intermediate transfer body cleaner 92 to detect whether or not the waste toner recovery bottle 98 has become full.

Each replaceable unit, having sensors, etc., for detecting predetermined conditions, is thus arranged to output the result of detection by the sensor, etc., to the control unit 106, and the control unit 106 is arranged to control the respective parts that make up the image forming device 10 based on the input detection results.

Next, a detailed description is given of the arrangement of control unit 106.

Figure 12:
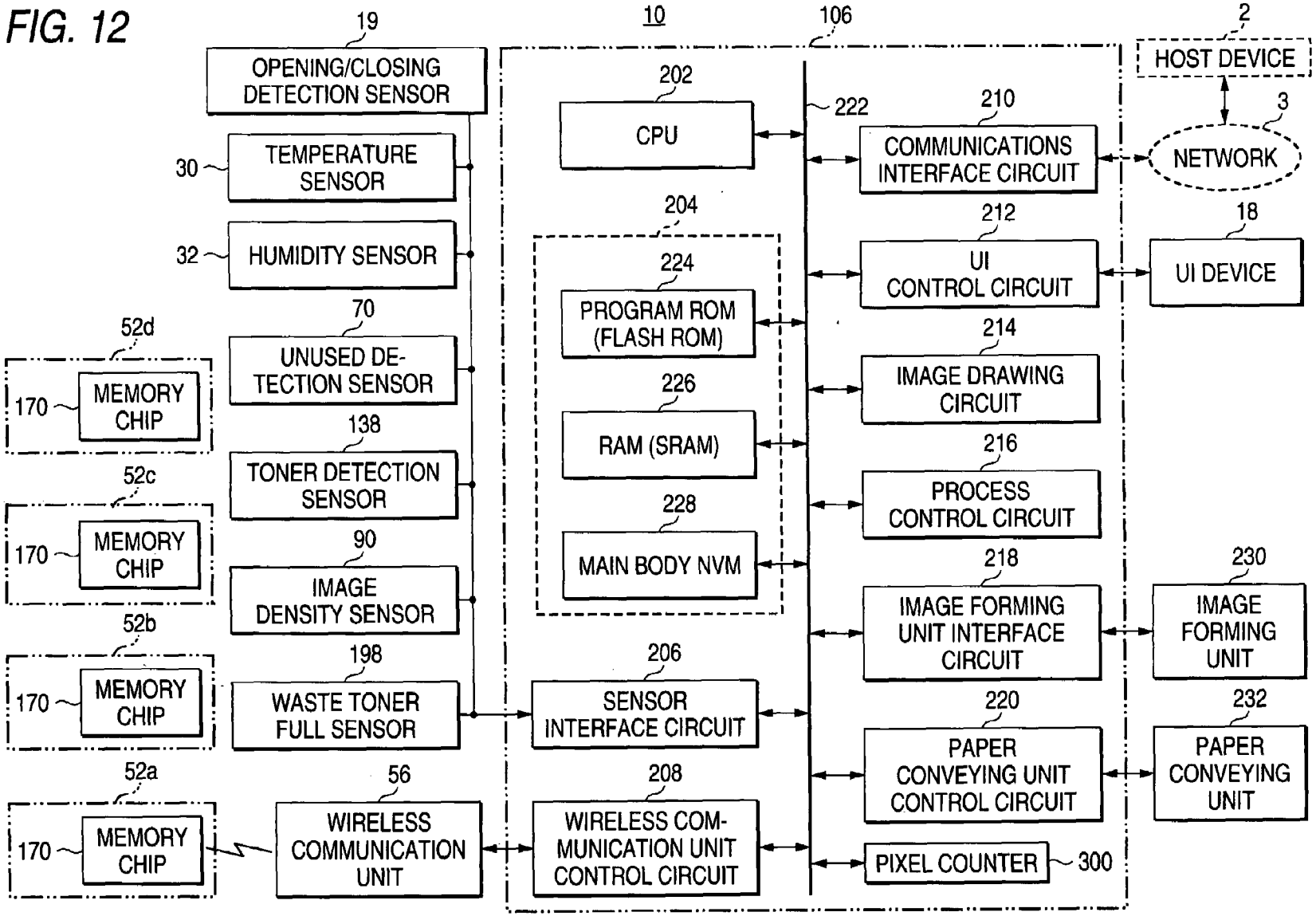
FIG. 12 is a block diagram showing the arrangement of a control unit of the image forming device of an embodiment according to the invention and various parts connected to the control unit.

FIG. 12 is a block diagram showing the arrangement of the control unit 106 and respective parts connected to the control unit 106.

The control unit 106 has a CPU 202, a storage unit 204, a sensor interface (sensor I/F) circuit 206, a wireless communications unit control circuit 208, a communication interface (communication I/F) circuit 210, a user interface (UI) control circuit 212, an image drawing circuit 214, a process control circuit 216, an image forming unit interface (image forming I/F) circuit 218, a paper conveying unit control circuit 220, etc., and these are arranged to be able to input and output signals to each other via a system bus 222.

The CPU 202 sends and receives signals to and from the respective parts that make up the control unit 106 via a system bus 222 and controls the respective parts that make up the control unit 106.

A storage unit 204 has a program ROM 224, a RAM 226, and a main body NVM (Non Volatile Memory) 228 and stores information that are necessary for control of the image forming device 10, etc. The program ROM 224 is arranged, for example, from a flash ROM and may be arranged to be renewed in the stored contents. The RAM 226 is arranged, for example, fro means RAM and stores temporary information, such as the drawing data inputted from the image drawing circuit 214. The main body NVM 228 is arranged from an electrically rewritable non-volatile memory, such as an EEPROM or a flash ROM. As long as the main body NVM 228 is a rewritable storage device that can hold data even when the power of the image forming device 10 is turned off, it may be an SRAM, with which the power supply is backed up by a battery, etc., an HDD (Hard Disk Drive), or an optical memory, etc.

A sensor I/F circuit 206 receives detection results from each of the opening/closing detection sensor 19, temperature sensor 30, humidity sensor 32, non-use detection sensor 70, toner detection sensor 138, image density sensor 90, and waste toner full sensor 198, and outputs the detection results via the system bus 222 to the CPU 202. The wireless communications unit control circuit 208 sends and receives signals to and from the four memory chips 170, provided in the toner cartridges 52*a* to 52*d*, respectively, via the wireless communications unit 56, sends and receives signals to and from the CPU 202, storage unit 204, etc., via the system bus 222, and thereby connects the respective memory chips 170 to the CPU 202, storage unit 204, etc.

The communication I/F circuit 210 sends and receives signals to and from the host device 2 via the network 3, sends and receives signals to and from the CPU 202, etc., via the system bus 222, and thereby connects the host device 2 to the CPU 202, etc. The UI control circuit 212 sends and receives signals to and from the UI device 18, sends and receives signals to and from the CPU 202, etc., via the system bus 222, and thereby connects the UI device 18 to the CPU 202, etc.

The image drawing circuit 214 draws an image based on image forming signals inputted from the host device 2, etc., and outputs to the CPU 202 and RAM 226. The process control circuit 216 references, along with the CPU 202, setting values, etc., to be described later, that are stored in the storage unit 204 and controls, via an I/F circuit 218, an image forming unit 230, which includes the exposure device 68, image forming unit 110, and developing device unit 44, etc. The paper conveying unit control circuit 220, along with the CPU 22, controls a paper conveying unit 232, which includes a feed roll 26, a retard roll 28, a resist roll 38, etc.

A pixel counter 300 counts the number of pixels which are turned on, page by page and for each of toner colors of cyan (C), magenta (M), yellow (Y) and black (B), and outputs the results to the CPU 202 and RAM 226. The CPU 202 calculates the ratio of pixel numbers, in which respective colors are turned on page by page, as printing coverage.

Since the CPU 202 can compare the data stored in the storage unit 204 and the data stored in the unit NVM 184 to judge the state of a toner cartridge 52 to which a memory chip 170 is attached, the memory chip 170 forms a part of the detecting unit even though it does not have a sensor.

Next, a detailed description is given of the data stored in the program ROM 224, main body NVM 228 and unit NVM 184.

Figure 13:
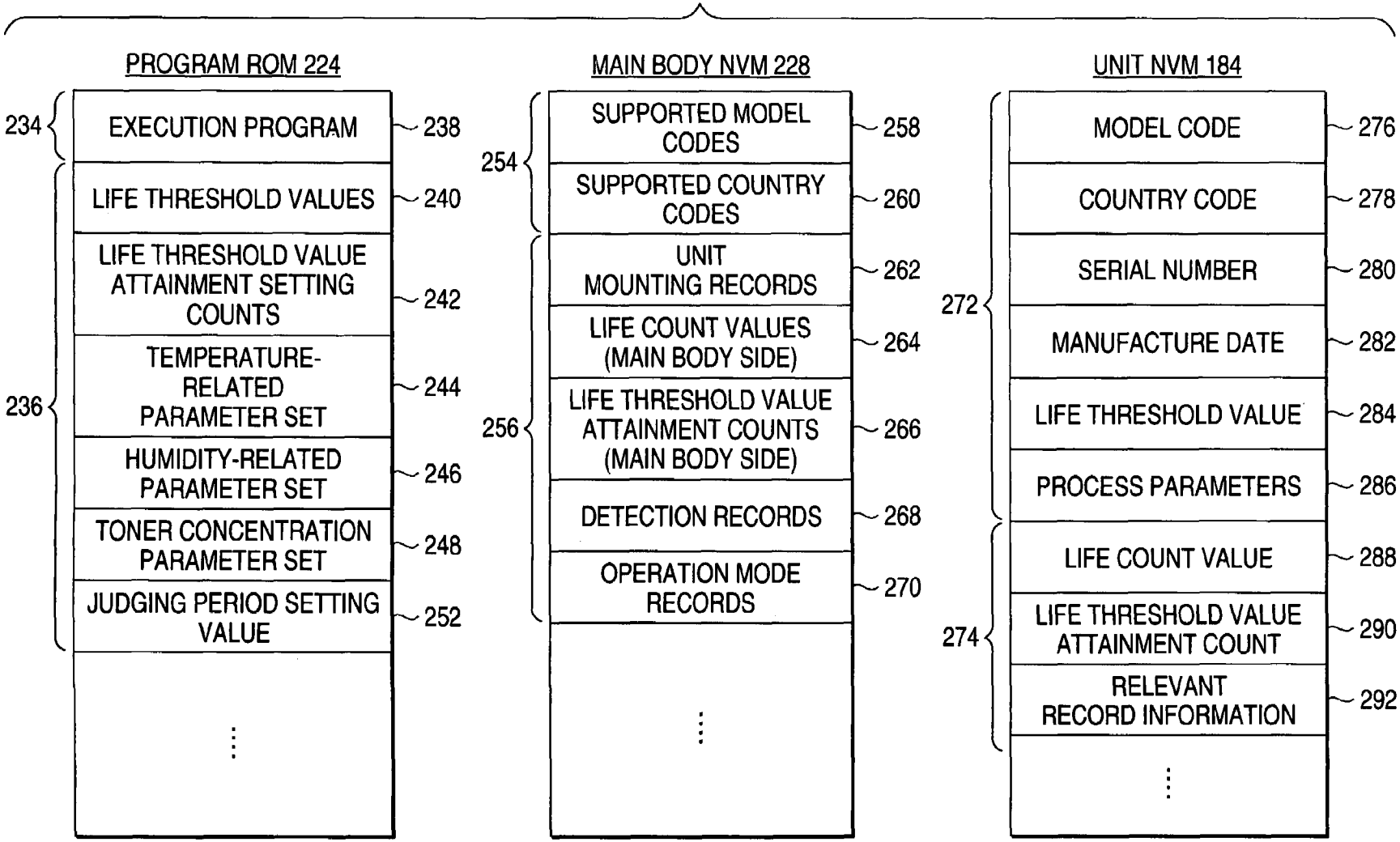
FIG. 13 is a memory map showing, as an example, data stored in a program ROM, a main body NVM, and a unit NVM.

FIG. 13 shows examples of the data stored in the program ROM 224, main body NVM 228 and unit NVM 184.

In the program ROM 224, a program area 234 and a setting value area 236 are provided. An execution program 238 for actuating the image forming device 10 is stored in the program area 234. Respective life threshold values 240, respective life threshold value attainment counts 242, temperature-related parameter set 244, humidity-related parameter set 246, toner concentration parameter set 248 and determination timing setting values 252, etc., are stored in the setting value area 236.

The respective life threshold values 240 include service lives (life threshold values) of respective replaceable units of the image forming device 10. The life threshold value attainment counts 242 includes the number of times by which the respective replaceable units of the image forming device 10 are permitted to reach the life threshold values. The temperature-related parameter set 244 includes respective parameters with respect to control for the temperature of the image forming device 10. The humidity-related parameter set 246 includes respective parameters with respect to control for the humidity of the image forming device 10. The toner concentration parameter set 248 includes respective parameters with respect to control for the toner concentration in the developing device 48. The determination timing setting value 252 includes a period of time (determination timing) until the CPU 202 commences determination on whether respective replaceable units of the image forming device 10 are genuine or other than genuine products, in a process (FIG. 15), described later, in which the image forming device 10 carries out printing preparation in accordance with an operation mode.

A supported unit information area 254, a main body side renewal area 256, etc., are set up in the main body NVM 228.

Supported model codes 258 and supported country codes 260 are stored in the supported unit information area 254. As the supported model codes 258, a table (data) of models, indicating, for each replaceable unit of the image forming device 10, that the model of the unit is compatible with the image forming device 10, is stored. As the supported country codes 260, a table (data) of respective countries, in which specifications that differ according to country are set for each of the respective replaceable units of the image forming device 10, is stored.

Unit mounting records 262, main body side life count values 264, main body side life threshold value attainment counts 266, detection records 268, and operation mode records 270, etc., are stored in the main body side renewal area 256. The unit mounting records 262 include the mounting records of the respective replaceable units of the image forming device 10. As the initial states (initial values) of the unit mounting records 262, values indicating that genuine products are mounted are stored. The main body side life count values 264 include the life count values (usage amounts from the start of use to present) of the respective replaceable units of the image forming device 10. The usage amounts of the respective units may be computed from the respective cumulative operation times of the units. The main body side life threshold value attainment counts 266 include the life threshold value attainment counts of the respective replaceable units of the image forming device 10. The detection records 268 include the records of the detection results of the respective sensors provided in the image forming device 10. The operation mode records 270 include the records of the operation modes that are applied to the respective replaceable units of the image forming device 10.

A unit information area 272, a unit side renewal area 274, etc., are set up in the unit NVM 184.

A model code 276 indicating the model, a country code 278 indicating the country for which the specifications have been set, a serial number 280 incidental to the unit, a manufacture date 282, a life threshold value 284 indicating the life of the unit, process parameters 286 for process control, etc., are stored in the unit information area 272.

The life count value 288, indicating the usage amount of the toner cartridge 52 from the start of use to the present, life threshold value attainment count 290 indicating the number of times the life threshold value stored as life threshold value 284 has been reached, relevant record information 292, etc., are stored in the unit side renewal area 27. Relevant record information 292 includes, for example, the records of the rotation speed of the image carrying body 54 and other relevant information that can be used to ascertain the circumstances of the toner cartridge 52.

When an image forming signal is sent to the image forming device 10 of the above-mentioned arrangement, the image carrying body 54 is uniformly charged by the charging device 60, and a light ray is emitted from the exposure device 68 onto the charged image carrying body 54 in accordance with the image signal. The light ray from the exposure device 68 exposes the surface of the image carrying body 54 and a latent image is formed thereby.

The latent image that is carried on the image carrying body 54 is developed at the developing position by the developing device unit 44. In the developing device unit 44, yellow, magenta, cyan, and black toners are supplied from the toner cartridges 52*a* to 52*d*, respectively, to the developing devices 48*a* to 48*d*, respectively. Developing agents that have been supplied in excess to the developing devices 48*a* to 48*d* are recovered in the toner cartridges 52*a* to 52*d*, respectively. Toner images, which have been developed according to color by the developing devices 48*a* to 48*d* of the developing device unit 44, are primarily transferred in an overlapping manner onto the intermediate transfer body 74. In the primary transfer process, the waste toner that remains on the image carrying body 54 is scraped off by the image carrying body cleaner 62 and recovered.

Meanwhile, paper housed in paper feed cassette 24 is sent out by the feed roll 26, separated and guided to the conveying path 34 by the retard roll 28, stopped once by the resist roll 38, and guided between the secondary transfer roll 88 and the secondary transfer backup roll 82 at an adjusted timing. When a sheet of paper is guided between the secondary transfer roll 88 and the secondary transfer backup roll 82, the four-color toner image resulting from overlapping onto the intermediate transfer body 74 by primary transfer is secondarily transferred onto the sheet of paper by the secondary transfer roll 88 and the secondary transfer backup roll 82. After the secondary transfer, the waste toner remaining on the intermediate transfer body 74 is scraped off by the intermediate transfer body cleaner 92 and recovered.

The sheet of paper onto which the toner image has been transferred is guided to the fixing device 100, and the toner image is fixed by heat and pressure by the heating roll 102 and pressing roll 104. The paper sheet on which the toner image has been fixed is ejected from the ejection opening 36 to the ejection part 42 by the ejection roll 40. The control unit 106 stores the life count values, etc., of the toner cartridges 52 in the unit NVM 184 and main body NVM 228.

Figure 14:
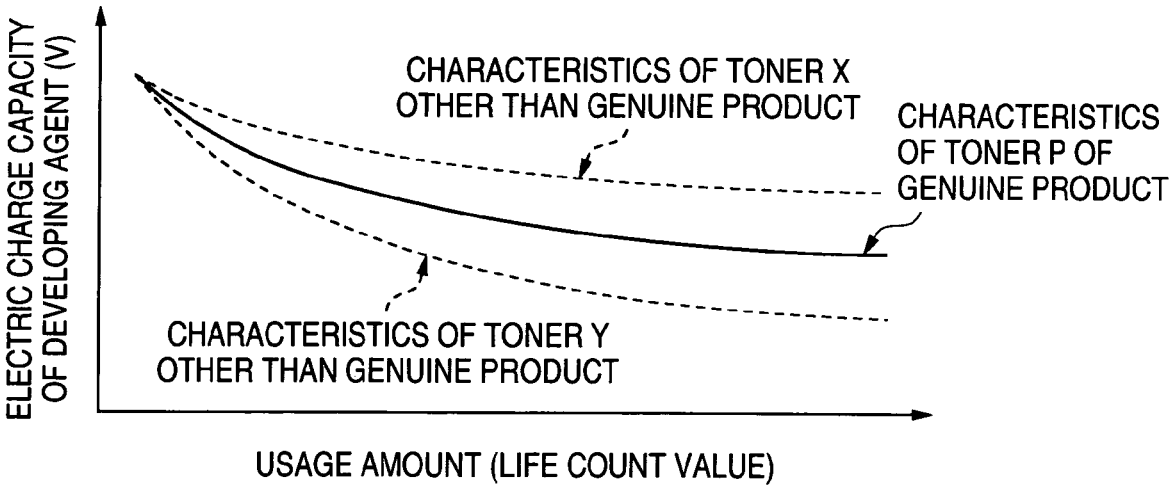
FIG. 14 is a graph showing changes in electric charge capacity of a developing agent with respect to the usage amount (life count value) of a developing agent stored in the main body NVM.

FIG. 14 is a graph showing changes in electric charge capacity of a developing agent with respect to the usage amount (life count value) of developing agents stored in the main body NVM 228.

Figure 15:
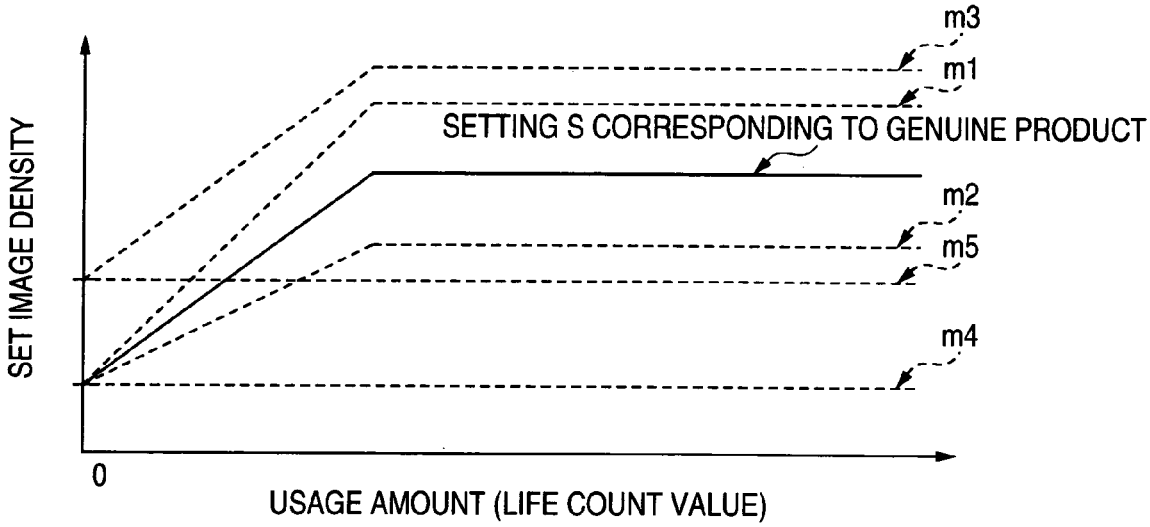
FIG. 15 is a graph showing setting for compensating changes in the electric charge capacity of a developing agent, which is a graph showing setting of the image density with respect to the usage amount of the developing agent.

FIG. 15 is a graph showing setting for compensating changes in the electric charge capacity of a developing agent, which is a graph showing setting of image densities with respect to the usage amount of a developing agent.

Figure 16A:
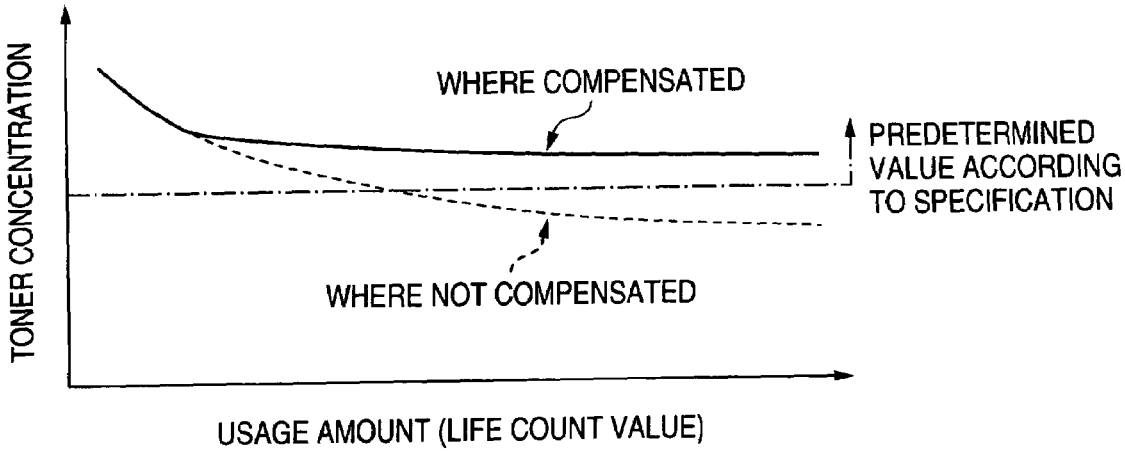
Figure 16B:
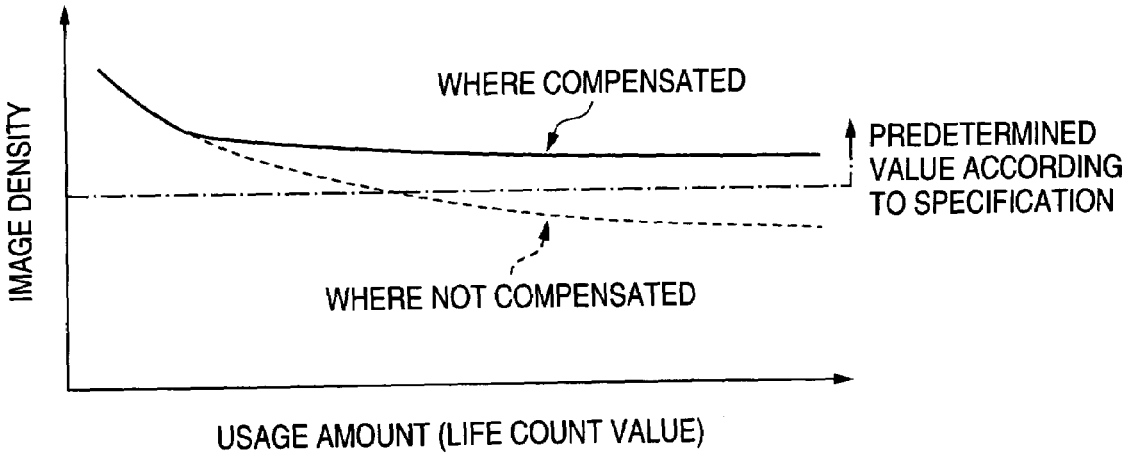

FIGS. 16A and 16B are graphs showing the results corrected by the setting shown in FIG. 15, wherein FIG. 16A shows compensated toner concentrations, and FIG. 16B is a graph showing compensated image densities.

Toners accommodated in the toner cartridge 52 are friction-charged to an electric charge amount having a predetermined polarity by a carrier in the developing device 48. If a developing agent is used, the electric charge capacity of the developing agent is lowered in accordance with the usage amount of the developing agent as in the characteristics of genuine toner P which is shown in FIG. 14.

Therefore, the image forming device 10 is devised so as to compensate settings with respect to toner concentration in the developing device 48 and the image densities on the intermediate transfer body 74 in order to maintain the image quality of an image formed on a sheet of paper at a predetermined level even if a trickle developing system is employed.

For example, the CPU 202 detects the image density by the image density sensor 90, controls the rotation drive of the first auger 118 if the density is high, reduces the toner amount supplied into the developing device 48, lowers the toner concentration, and reduces the image density. Also, if the density is low, the CPU 202 controls the rotation drive of the first auger 118, increases the toner amount supplied into the developing device 48, raises the toner concentration and raises the image density. Usually, a pattern having an intermediate tone density is employed as a pattern for detecting the above-mentioned image density.

However, if the above-mentioned control is carried out as it is since the developing performance is increased to raise the image density if the electric charge capacity of toner is lowered, the toner concentration is excessively lowered, wherein the maximum image density will be lowered.

Therefore, set values for controlling the toner concentration in the developing device 48, which are stored in the toner concentration parameter set 248 used for toner concentration control on the basis of the results of image density detection by the image density sensor 90 are compensated so as to be increased in accordance with the usage amount of a developing agent so that, even if the electric charge capacity of the developing agent is lowered, the maximum image density transferred onto paper is not lowered. The CPU 202 causes the first auger 118 to rotate in accordance with the compensated set values (FIG. 15: Setting S corresponding to the toner P) and maintains the toner concentration so that the toner concentration does not become lower than a predetermined value as shown in FIG. 16A.

Resultantly, it is possible to maintain the image density so that the image density does not become lower than a predetermined value according to the specification as shown in FIG. 16B.

On the other hand, where a toner cartridge is mounted, which is other than a genuine product, having roughly the same structure as that of the toner cartridge 52 accommodating toner X or toner Y which is other than a genuine product with respect to the image forming device 10, it is predictable that characteristics differing from the characteristics P of a toner which is a genuine product as shown in FIG. 14 are brought about. Therefore, a compensated set value differing from the setting S corresponding to the toner P is required in order to improve the quality of an image formed on a sheet of paper. Accordingly, for example, where a toner cartridge, in which toner X or toner Y is accommodated, is other than a genuine product, such a compensation is changed, with respect to the usage amount of a developing agent by combining changing conditions such as increasing or decreasing a change amount (inclination) of the set value of the toner concentration (m1, m2: FIG. 15), increasing or decreasing the limit value (m1, m2), changing the initial value (usage amount=0) (m3), not changing the set value responsive to the usage amount (m4), and not changing the set value responsive to the usage amount by changing, for example, the initial value (m5), etc. The change is carried out by selection made by a user via the UI device 18 in an operation mode differing from the operation mode corresponding to a genuine product.

Next, a description is given of control of the image forming device 10 based on data stored in the storage unit 204 and unit NVM 184.

The image forming device 10 controls screens displayed in the host device 2, described later, on the basis of the data stored in the storage unit 204 and unit NVM 184. Where the toner cartridge 52 accommodating genuine toner P is mounted to the image forming device 10, the CPU 202 calculates the residual amount of toner based on the usage amount stored in the unit NVM 184 of the toner cartridge 52. The image forming device 10 causes the host device 2 to display the calculated residual amount of toner on the basis of control of the CPU 202.

On the other hand, where a toner cartridge 52 accommodating toner X, which is not a genuine product, is mounted to the image forming device 10, there may be cases where the CPU 202 cannot correctly calculate the residual amount of toner because there is no correlation between the usage amount stored in the unit NVM 184 of the toner cartridge 52 and the residual amount of toner. In these cases, the image forming device 10 causes the host device 2 to stop displaying the residual amount of toner on the basis of control of the CPU 202. Or, the image forming device 10 causes the host device 2 to display the printing coverage measured or metered since the toner cartridge 52 was mounted, on the basis of control of the CPU 202.

In addition, the CPU 202 may cause the UI device 18 to display information regarding the usage amount of the toner cartridge 52 such as the residual amount of toner.

Figure 17:
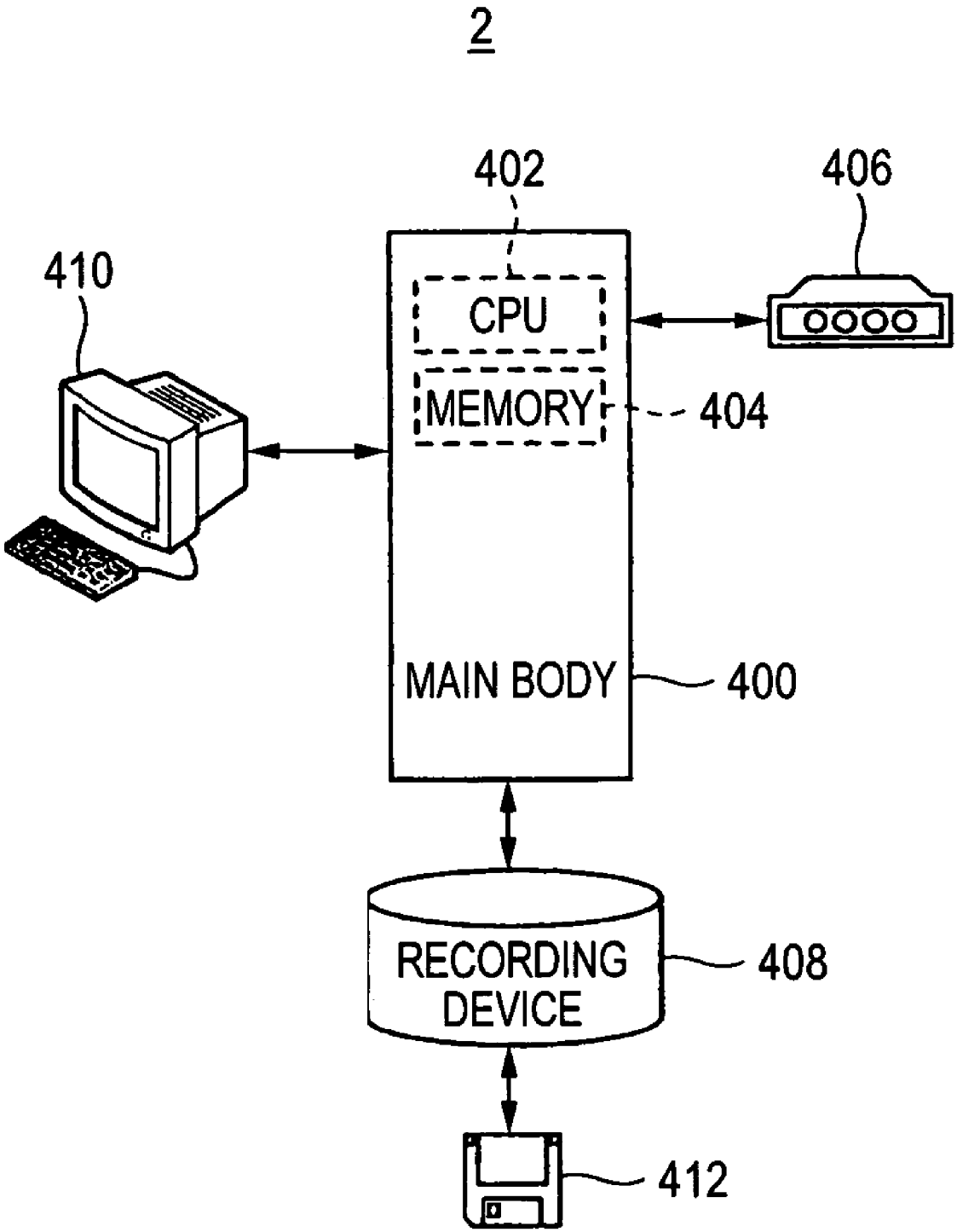
FIG. 17 is a view showing a hardware configuration of the host device as an example.

FIG. 17 is a view showing a hardware configuration of the host device 2 shown in FIG. 1.

As shown in FIG. 17, the host device 2 includes a main body 400 having a CPU 402 and a memory 404, a display/input device 410 having a liquid crystal display/keyboard and a mouse (not illustrated), a recording device 408 such as a HDD/CD unit, and a communication device 406 for communications between the host device and a network.

That is, the host device 2 includes a structure portion similar to a general computer capable of carrying out communications via a network.

Figure 18:
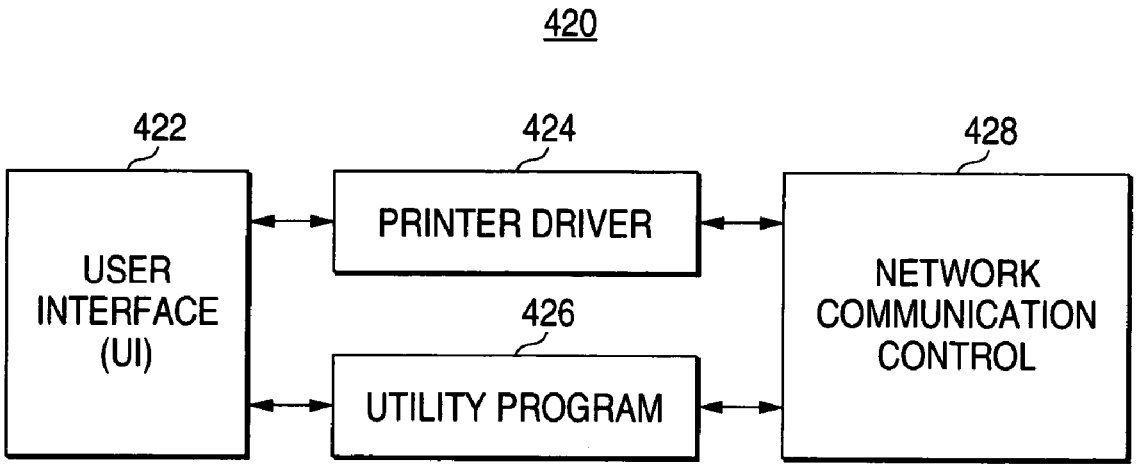
FIG. 18 is a view showing a configuration of a client program operating in the host device.

FIG. 18 is a view showing a configuration of a client program 420 operating in the host device 2 shown in FIG. 1.

As shown in FIG. 18, the client program 420 is composed of a user interface (UI device) 422, a printer driver 424, a utility program 426 and a network communication control portion 428.

The client program 420 is supplied to the recording device 408 of the host device 2 via, for example, a recording medium 412, and loaded in the memory 404 and is executed. The client program 420 provides a user, who uses the host device 2, with a status inspecting feature and a setting changing feature of the image forming device 10 on the basis of the components described above, and displays messages transmitted from the image forming device 10 via the network 3.

In the client program 420, the UI device 422 accepts operations of a user with respect to the display/input device 410 and controls processes of respective components of the client program 420. In addition, the UI device 422 displays to a user the data that the printer driver 424 or utility program 426 received via the network 3.

The printer driver 424 provides a user of the host device 2 with a status displaying feature of the image forming device 10, in further detail, a displaying feature of information regarding the usage amount of a replacement unit mounted to the image forming device 10. Also, the printer driver 424 provides a message notifying feature from the image forming device 10.

The utility program 426 provides a user of the host device 2 with a status displaying feature of the image forming device 10, in further detail, a displaying feature of information regarding the usage amount of a replacement unit mounted to the image forming device 10 as in the printer driver 424. The utility program 426 also provides a user with the above-mentioned feature even in a case where a plurality of types of image forming devices are connected to the network 3.

The network communication controlling portion 428 controls communications with the image forming device connected via the network 3 shown in FIG. 1.

Next, a description is given of a controlling method of the image forming device on the basis of the data stored in the storage unit 204 and unit NVM 184.

Figure 19:
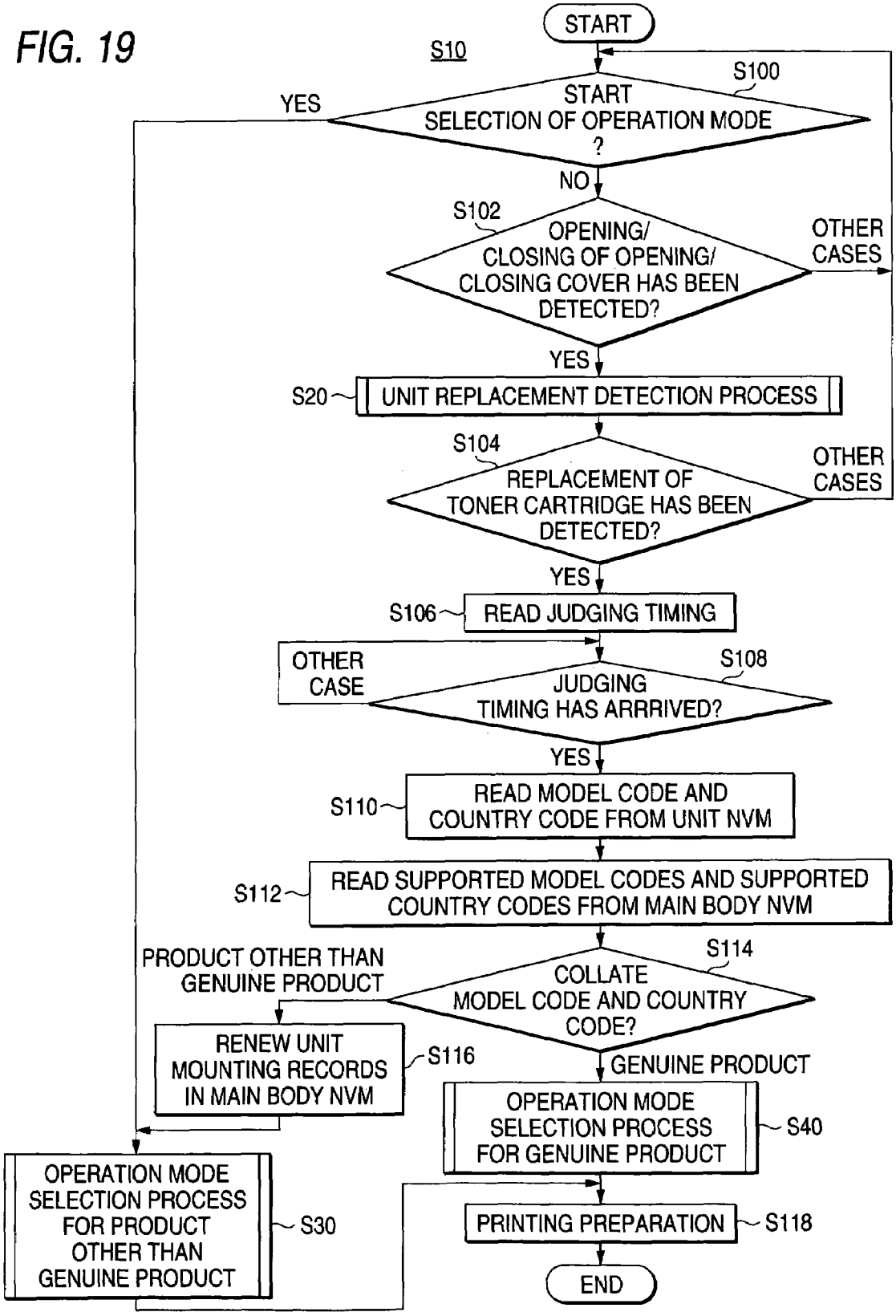
FIG. 19 is a flow chart (S10) showing a process, along which the image forming device carries out printing preparation in accordance with an operation mode, with respect to a toner cartridge.

FIG. 19 is a flow chart (S10) showing a process for the image forming device 10 carrying out a printing preparation in accordance with an operation mode with respect to a toner cartridge 52.

Figure 20:
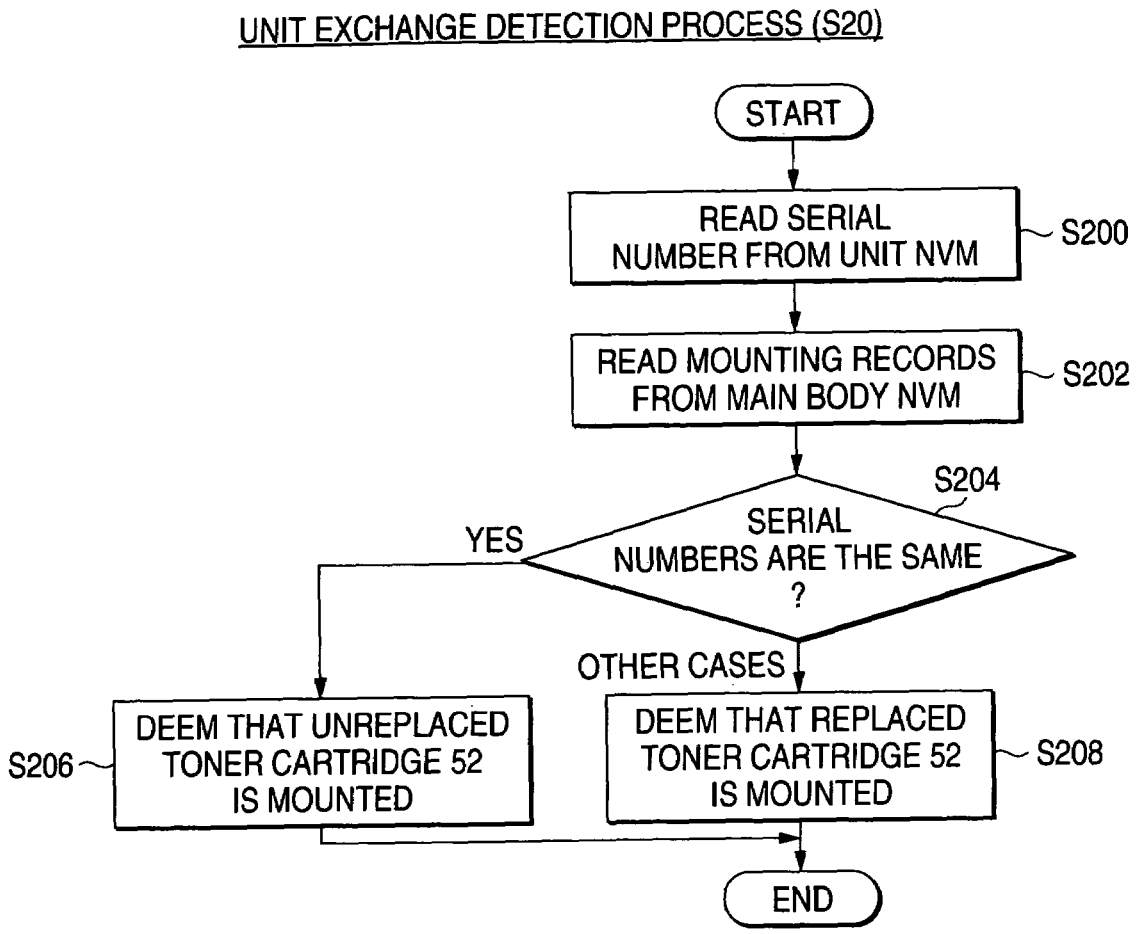
FIG. 20 is a flow chart (S20) showing a unit replacement detecting process, which detects whether or not a toner cartridge has been replaced.

FIG. 20 is a flow chart (S20) showing a unit replacement detecting process for detecting whether or not the toner cartridge 52 is replaced.

Figure 21:
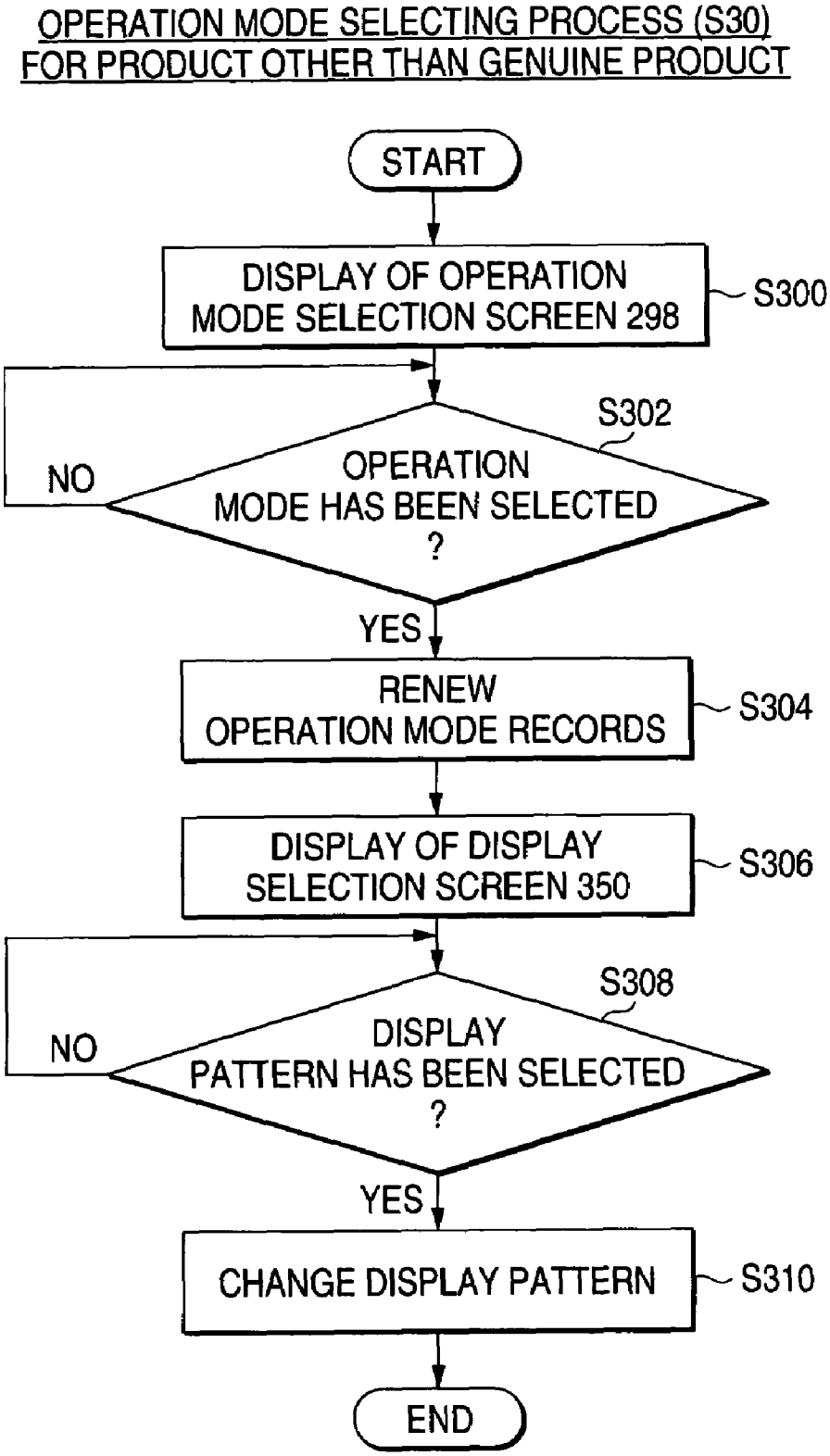
FIG. 21 is a flow chart (S30) showing an operation mode selecting process that the image forming device carries out with respect to a toner cartridge other than a genuine product in order for a user to select an operation mode for the toner cartridge other than a genuine product.

FIG. 21 is a flow chart (S30) showing an operation mode selecting process that the image forming device 10 carries out with respect to a toner cartridge other than a genuine product, in order for a user to select an operation mode for a toner cartridge which is other than a genuine product.

Figure 22:
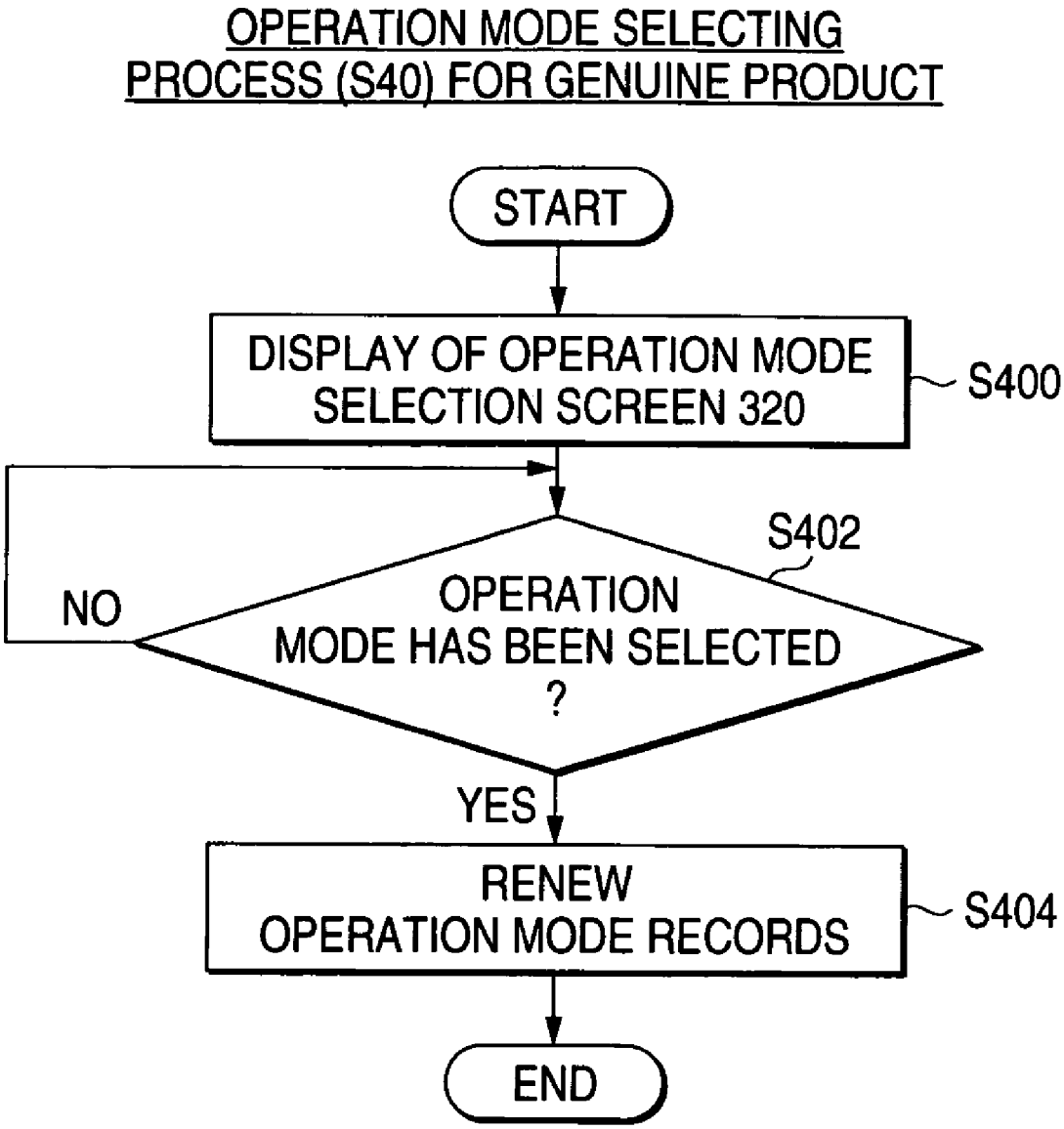
FIG. 22 is a flow chart (S40) showing an operation mode selecting process that the image forming device carries out with respect to a genuine toner cartridge in order for a user to select the operation mode corresponding to the genuine product.

FIG. 22 is a flow chart (S40) showing an operation mode selecting process that the image forming device 10 carries out with respect to a genuine toner cartridge, in order for a user to select the operation mode for a genuine toner cartridge.

Figure 23:
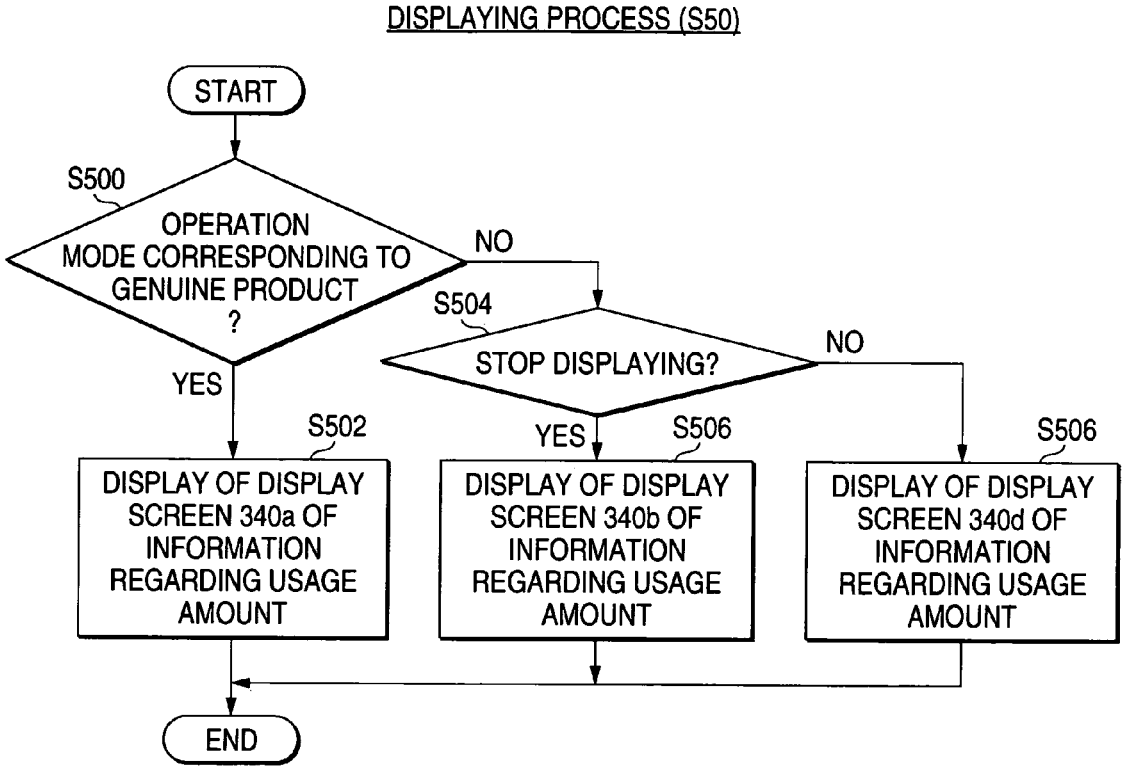
FIG. 23 is a flow chart (S50) showing a display process for displaying a screen showing information regarding the usage amount in the display/input device of the host device when commencing printing.

FIG. 23 is a flowchart (S50) showing a displaying process by which a screen showing information regarding the usage amount is displayed on the display/input device 410 of the host device 2 when commencing printing.

As shown in FIG. 19, in Step 100 (S100), by a user operating the UI device 18, the CPU 202 determines whether an input is provided, which commences selection of operation modes. Where an input for commencing selection of the operation modes is provided, the process advances to S30, and where no input for commencing selection of the operation modes is provided, the process advances to S102.

In step 102 (S102), the CPU 202 determines whether or not the opening/closing detection sensor 19 has detected the opening/closing of the opening/closing cover 16. If the CPU 202 determines that the opening/closing of the opening/closing cover 16 has been detected, the process of S20 is entered, and in other cases, the process of S100 is entered. That is, since when the opening/closing cover 16 has been opened and closed, there is a possibility that the toner cartridge 52 has been replaced, a unit replacement detection process is performed.

In step 200 (S200; FIG. 20), the CPU 202 reads a serial number 280 from the unit NVM 184.

In step 202 (S202), the CPU 202 reads the serial number of the toner cartridge that was mounted last, which is included in the unit mounting records 262 in the main body NVM 184.

In step 204 (S204), the CPU 204 determines whether or not the serial number of the toner cartridge that was mounted last and the serial number 280 read from the unit NVM 184 are the same. If the serial number of the toner cartridge that was mounted last and the serial number 280 read from the unit NVM 184 are the same, the process of S206 is entered, and in other cases, the process of S208 is entered.

In step 206 (S206), the CPU 202 deems that a toner cartridge 52 has been mounted again without being replaced (that replacement has not been performed).

In step 208 (S208), the CPU 202 deems that a toner cartridge 52 has been mounted upon being replaced (that replacement has been detected).

In step 104 (S104; FIG. 19), if the CPU 202 had deemed that the replacement of the toner cartridge 52 has been detected, the process of S106 is entered, and in other cases, the process of S100 is entered.

In step 106 (S106), the CPU 202 reads a determination timing setting value 252 from the program ROM 224.

The value of the determination timing setting value 252 may be 0.

In step 108 (S108), the CPU 202 determines, based on a timer (not illustrated), etc., whether or not the determination timing has arrived for starting the determination of whether the mounted toner cartridge 52 is a genuine product or a product other than a genuine product. If the determination timing, for starting the determination between a genuine product and a product other than a genuine product, has arrived, the process of S110 is entered, and in other cases, the CPU 202 waits until the determination timing arrives.

In step 110 (S110), the CPU 202 reads a model code 276 and a country code 278 from the unit NVM 184.

In step 112 (S112), the CPU 202 reads a supported model codes 258 and a supported country codes 260 from the main body NVM 228.

In step 114 (S114), the CPU 202 collates a model code 276 with a supported model codes 258, collates a country code 278 with a supported country codes 260, and if it is determined that the replaced toner cartridge 52 is a genuine product, the process of S40 is entered while if it is determined that the replaced toner cartridge 52 is a product other than a genuine product, the process of S116 is entered.

In step 116 (S116), the CPU 202 renews the mounting record of the toner cartridge 52, which is included in the unit mounting records 262 of the main body NVM 228, in accordance with the data read from the presently mounted toner cartridge 52 and then enters the process of S30.

Figure 24A:
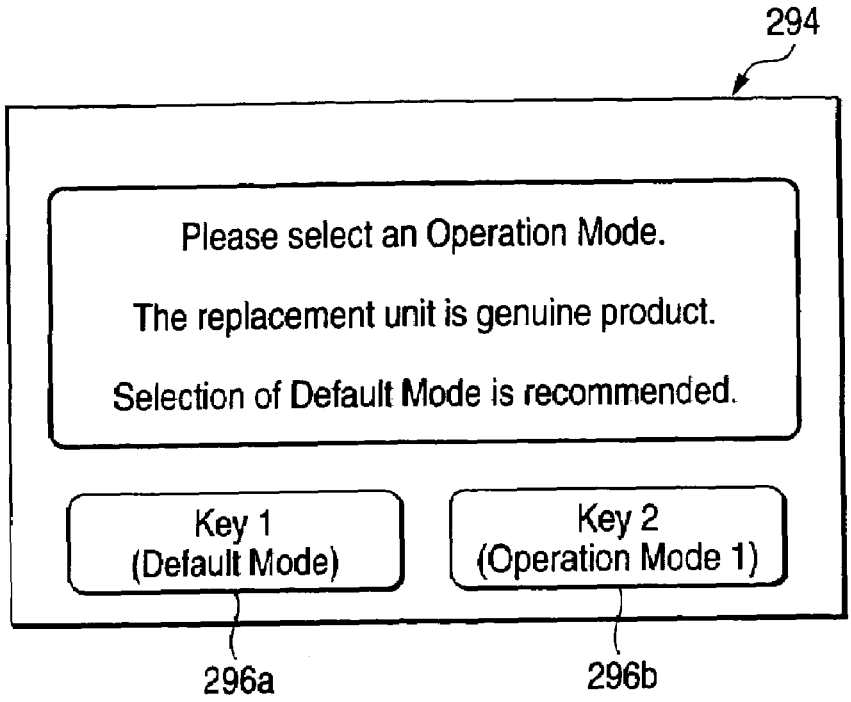
Figure 24B:
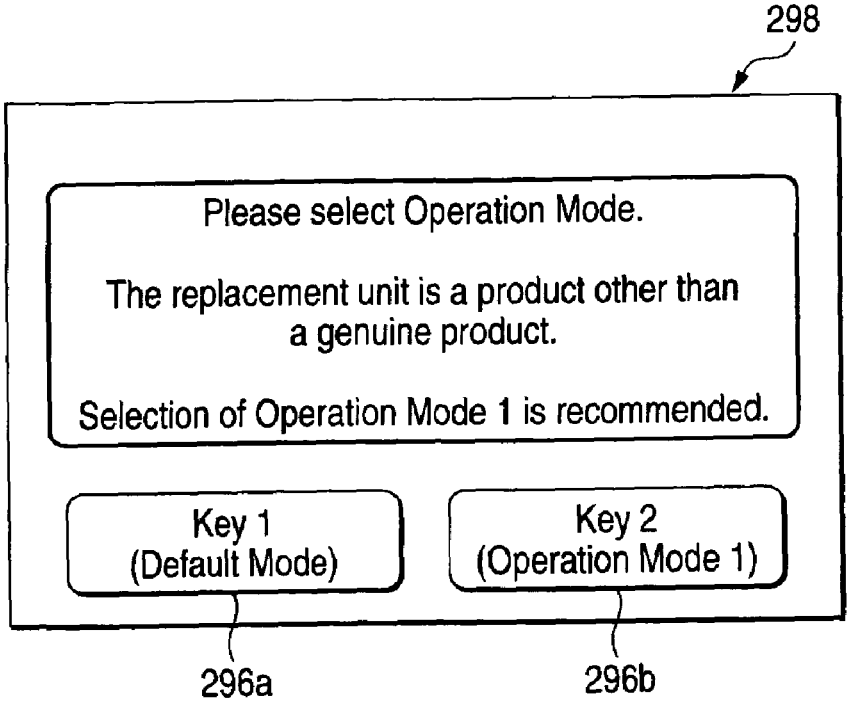

In step 300 (S300; FIGS. 24A and 24B), the UI device 18 displays an operation mode selecting screen 298, which is shown in FIG. 24B.

In step 302 (S302), the CPU 202 determines whether or not an input, of selecting between a key button 296*a* for selection of the default mode (operation mode accommodating a genuine product) and a key button 296*b* for designating another operation mode, which are displayed in the operation mode selecting screen 298, has been made. If an input selecting one of either key button 296*a* or 296*b* has been made, the process of S304 is entered, while if there is no input that designates either operation mode, the image forming device 10 waits until a user selects an operation mode.

In step 304 (S304), the CPU 202 performs renewal (including overwriting) of the operation mode records 270 in the main body NVM 228 with the operation mode selected in S302.

Figure 25:
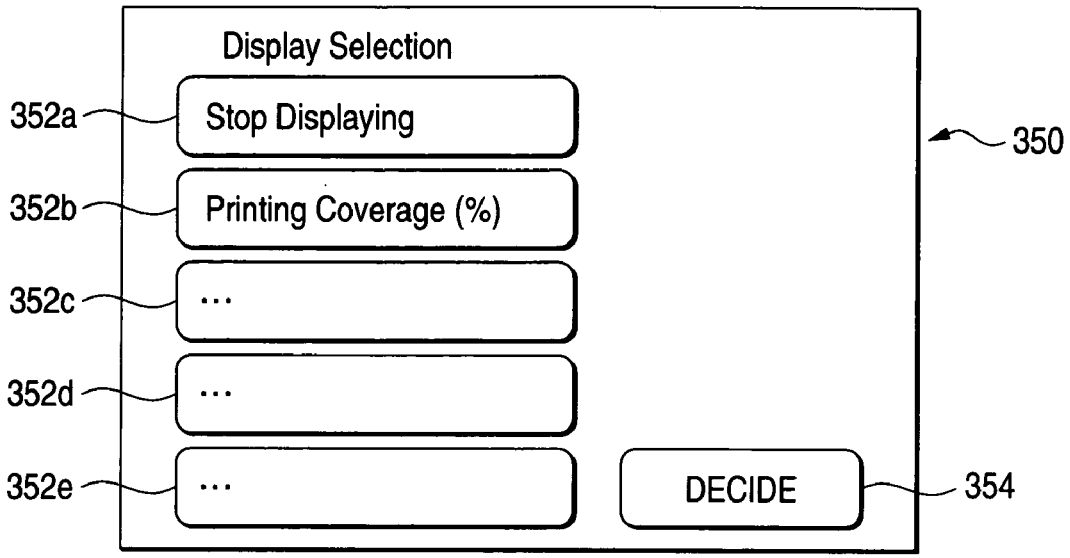
FIG. 25 is a view showing a display pattern selecting screen for selecting a display pattern of information regarding the usage amount displayed in the UI device 18 where it is determined that a toner cartridge 52 is other than a genuine product.

In Step 306 (S306), the UI device 18 displays a display pattern selecting screen 350 shown in FIG. 25.

In Step 308, the CPU 202 determines whether or not any one of the display pattern selecting buttons 352*a* through 352*e* displayed on the display pattern selecting screen 350 is selected and the determination button 354 is pressed. Where any one of the display patterns is selected and the determination button 354 is pressed, the process advances to Step 310, and where no input of designating any one of the display patterns is provided, the image forming device 10 waits until a user selects a display pattern.

In Step 310 (S310), the CPU 202 changes the display pattern so that information regarding the usage amount of the toner cartridge 52 is displayed in the selected display pattern.

In step 400 (S400; FIG. 22), the UI device 18 displays an operation mode selection screen 294, which is shown in FIG. 24A.

In step 402 (S402), the CPU 202 determines whether or not an input, of selecting between a key button 296*a* for selection of the default mode (operation mode accommodating a genuine product) and a key button 296*b* for designating another operation mode, which are displayed in the operation mode selection screen 294, has been made. If an input selecting one of either key button 296*a* or 296*b* has been made, the process advances to S404, while if there is no input that designates either operation mode, the image forming device 10 waits until a user selects an operation mode.

In step 404 (S404), the CPU 202 performs renewal (including overwriting) of the operation mode records 270 in the main body NVM 228 with the operation mode selected in S402.

In step 118 (S118; FIG. 19), the CPU 202 carries out printing preparations in accordance with the selected operation mode that is contained in the most recent operation mode records 270 and ends the processes. In the printing preparations of S118, for example, that the mounted toner cartridge 52 is a genuine product or a product other than a genuine product may be made to be displayed on the UI device 18.

When a printing process is carried out after the printing preparation in Step 118 is completed, as shown in FIG. 23, in Step 500 (S500), the CPU 202 determines whether or not the image forming device 10 is controlled in the operation mode corresponding to a genuine product. Where the image forming device 10 is controlled in the operation mode corresponding to a genuine product, the process advances to Step 502, and in other cases, the process advances to S504.

Figure 26A:
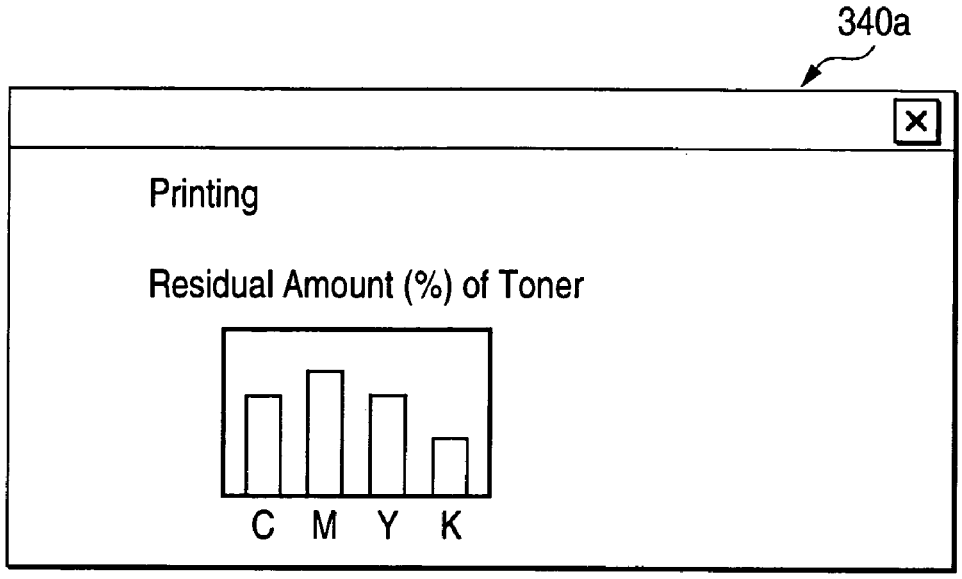

In Step 502 (S502), the CPU 202 outputs data with respect to a screen 340*a*, which includes the respective residual amounts of cyan (C), magenta (M), yellow (Y) and black (B) and a message showing that the image forming device 10 is in printing, to the host device 2 as shown in FIG. 26A, and the screen 340*a* is displayed in the display/input device 410 of the host device 2.

In Step 504 (S540), the CPU 202 determines whether or not stopping of display of information regarding the usage amount is selected where the image forming device 10 is controlled in an operation mode differing from the operation mode corresponding to a genuine product. Where stopping of the display is selected, the process advances to S506, and in other cases, the process advances to S508.

Figure 26B:
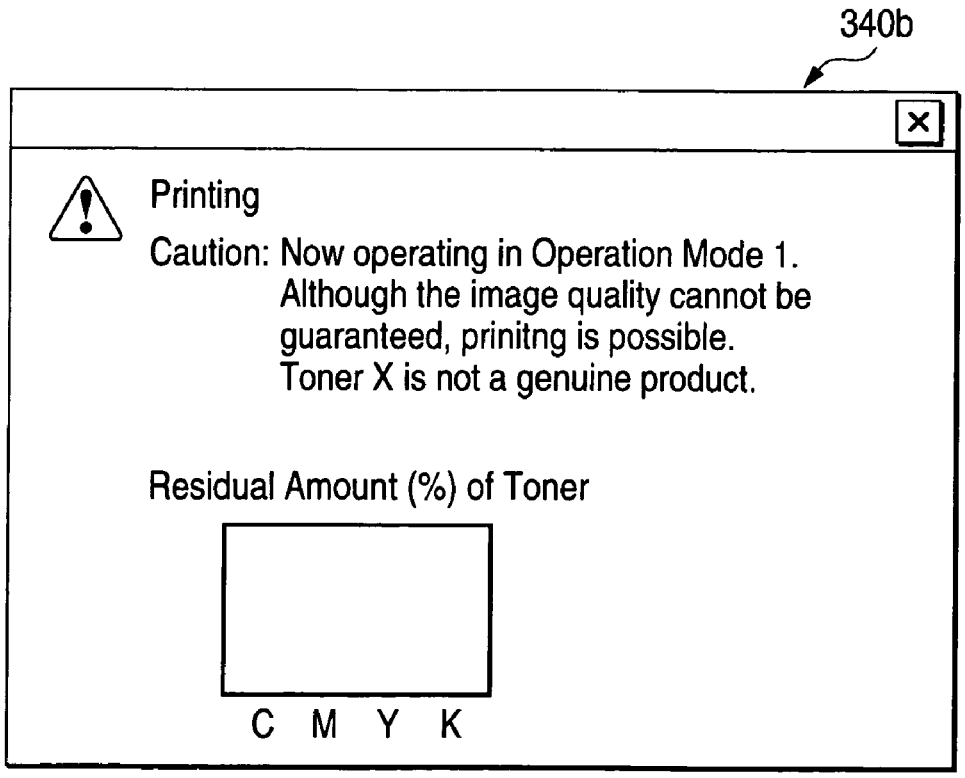

In Step 506 (S506), as shown in FIG. 26B, the CPU 202 outputs data regarding the screen 340*b*, which includes the image forming device 10 in printing, the operation mode in which the image forming device 10 is controlled, a toner cartridge 52 other than a genuine product, and a message showing another message of arousing a caution to a user, to the host device 2, and the screen 340*b* is displayed in the display/input device 410 of the host device 2. At this time, in the screen 340*b*, display of information regarding the usage amount of the toner cartridge 52 is stopped.

Figure 27A:
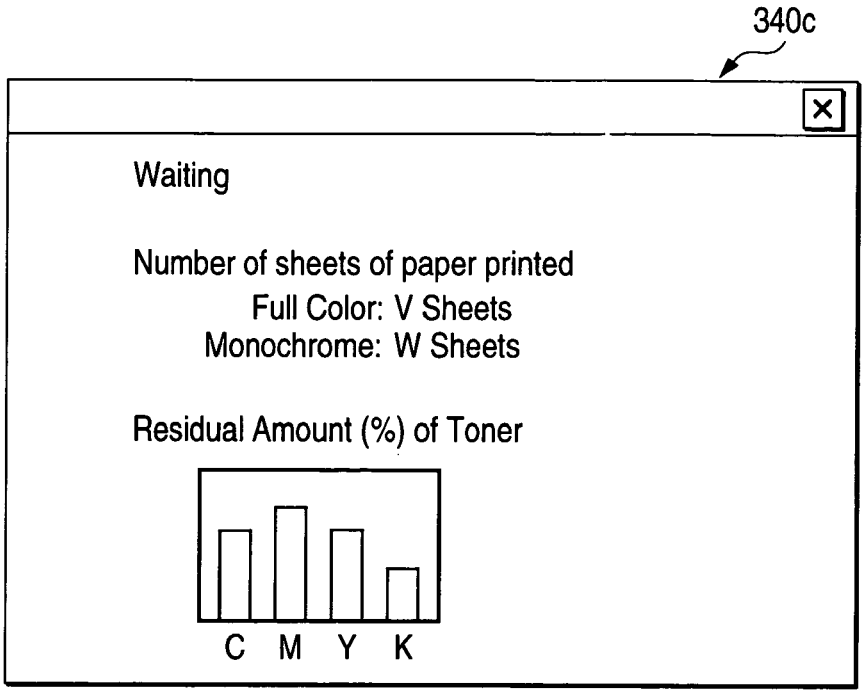
Figure 27B:
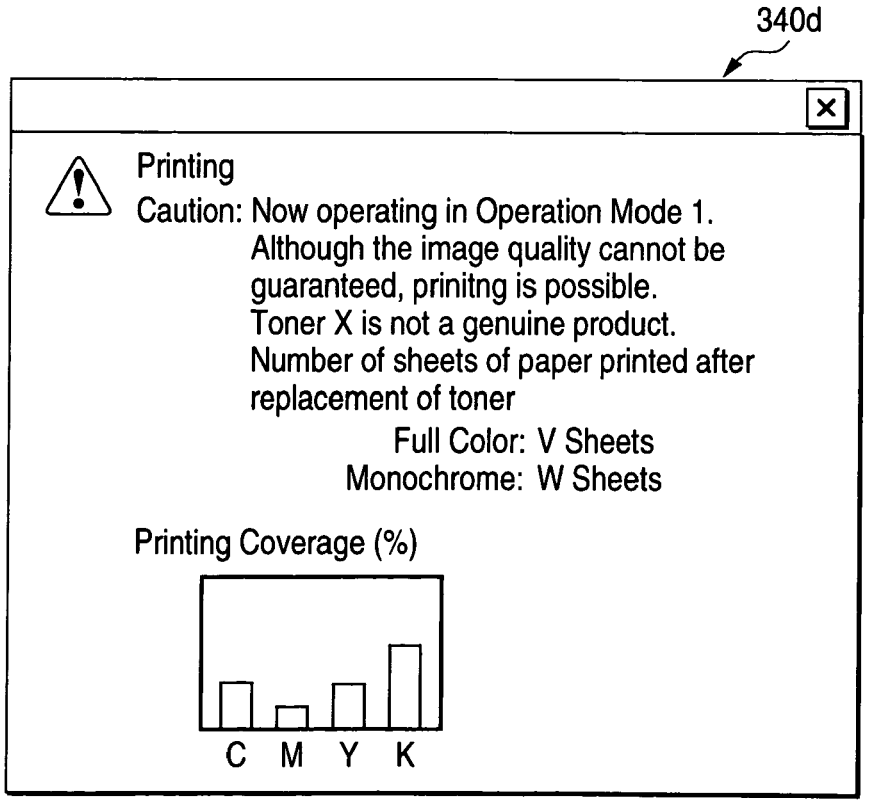

In Step 508 (S508), as shown in FIG. 27B, the CPU 202 outputs data regarding the screen 340*d* including the respective printing coverage of cyan (C), magenta (M), yellow (Y) and black (B) measured or metered from the mounting of the toner cartridge 52, the image forming device 10 in printing, the operation mode in which the image forming device 10 is controlled, toner cartridge 52 other than a genuine product, number of sheets of paper already printed in full color and in monochrome color, which is measured and metered from the mounting of the toner cartridge 52, and a message of arousing a caution to a user, to the host device 2, and the screen 340*d* is displayed in the display/input device 410 of the host device 2.

Thus, the CPU 202 of the image forming device 10 outputs data regarding the operation mode and the toner cartridge 52 other than a genuine product to the host device 2 via the network 3. Since the host device 2 displays information regarding the operation mode and a replacement unit other than a genuine product, a user is able to correctly recognize the use state of the toner cartridge 52 mounted at present.

Further, if a user checks the status of the image forming device 10 using the display/input device 410 of the host device 2 where the image forming device 10 is controlled in the operation mode corresponding to a genuine product, a screen 340*c* including the residual amounts of respective toners of cyan (C), magenta (M), yellow (Y) and black (B), the image forming device 10 being in a waiting state, and the number of sheets of paper already printed, which has been measured and metered from the mounting of the toner cartridge 52, is displayed in the display/input device 410 of the host device 2.

Where the image forming device 10 is controlled in an operation mode differing from the operation mode corresponding to a genuine product, the CPU 202 of the image forming device 10 may stop displaying the residual amount of toner and display the printing coverage instead of displaying the residual amount of toner.

Further, it may be devised that a plurality of other operation modes differing from the operation mode corresponding to a genuine product are provided and a user can freely select an operation mode among the plurality of other operation modes.

Thus, even if a replaceable unit of the image forming device 10 is other than a genuine product, the image quality can be improved by a user selecting an operation mode differing from the operation mode corresponding to the genuine product, and, by changing the display pattern, utility and convenience of a user can be maintained.

Also, where all the replaceable units are genuine products, the operation mode which a user can select is limited so that the image forming device 10 operates only in the operation mode corresponding to a genuine product, wherein it is possible to prevent that a user erroneously lowers the image quality.

Second Embodiment

An image forming device and an image forming system of the second embodiment includes configurations of the first embodiment that are explained by FIGS. 1 to 27. Therefore, in this embodiment, explanations of the overlapped configurations are omitted.

In this embodiment, a description is given of control of an image forming device 10 based on data stored in a storage unit 204 and a main unit NVM 184.

Based on the data stored in the storage unit 204 and main unit NVM 184, the image forming device 10 controls display made by the UI device 18. For example, on the basis of control by the CPU 202, the UI device 18 displays the remaining quantity of toner when the toner cartridge 52 is genuine, and displays the use quantity of toner when the toner cartridge 52 is other than a genuine cartridge. This is because, where the toner cartridge is other than a genuine cartridge, the remaining quantity of toner cannot be calculated since the toner quantity is not clear.

Next, a description is given of a method for controlling the image forming device 10 on the basis of data stored in the storage unit 204 and main unit NVM 184.

FIG. 19 is a flowchart (S10) showing a process along which the image forming device 10 carries out printing preparation in accordance with an operation mode with respect to the toner cartridge 52.

FIG. 20 is a flowchart (S20) showing a process for detecting unit exchange, which detects whether or not the toner cartridge 52 is replaced.

Figure 28:
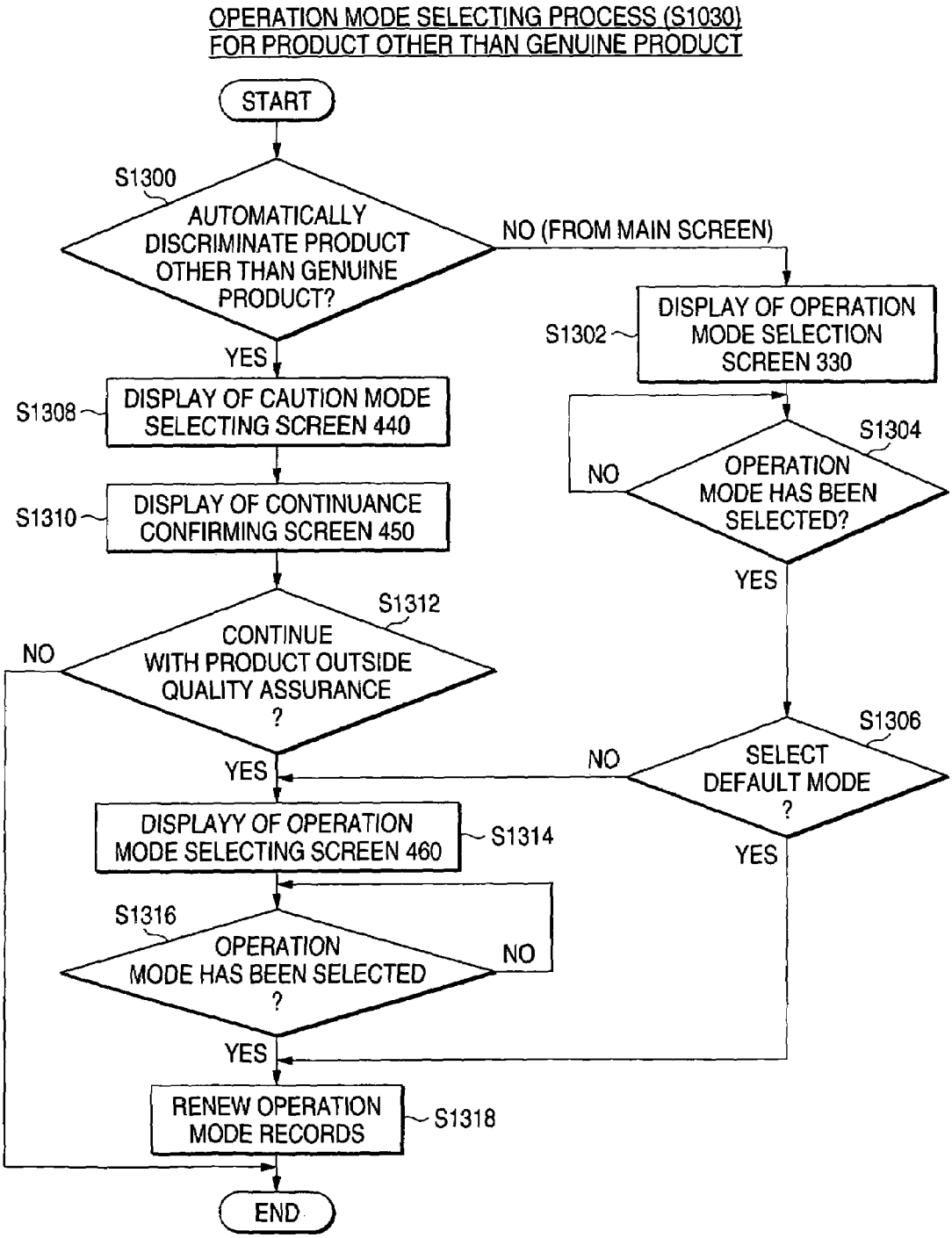
FIG. 28 is a flowchart (S1030) showing a guidance information displaying/operation mode selecting process carried out by the image forming device in order for a user to select an operation mode while checking the guidance information display.

FIG. 28 is a flowchart (S1030) showing an operation mode selecting process, with respect to toner cartridges other than a genuine cartridge, along which the image forming device 10 carries out in order for a user to select an operation mode with respect to a toner cartridge other than a genuine cartridge.

FIG. 22 is a flowchart (S40) showing an operation mode selecting process which is carried out by the image forming device 10 with respect to a genuine toner cartridge in order for a user to select an operation mode with respect to a genuine toner cartridge.

Figure 29:
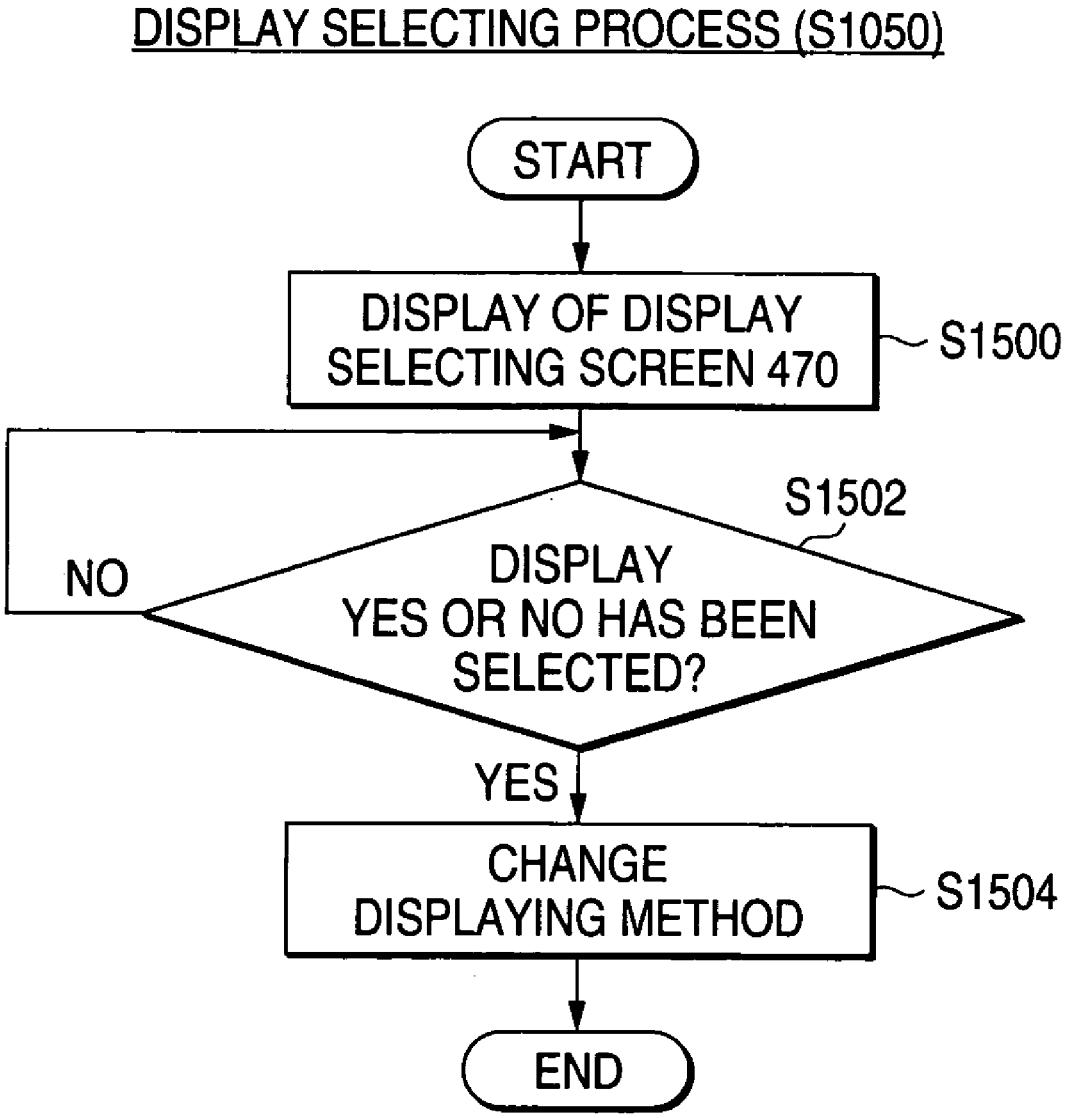
FIG. 29 is a flowchart (S40) showing a display selecting process carried out by the image forming device in order for a user to select a displaying method.

FIG. 29 is a flowchart (S1050) showing a display selecting process which is carried out by the image forming device 10 in order for a user to select a method for displaying added messages.

As shown in FIG. 19, in Step 100 (S100), the CPU 202 determines whether or not an input for a user to start selecting an operation mode by operating the UI device 18 is provided. Where an input to start selecting the operation mode is provided, the process advances to S1030, and where no input to start selecting the operation mode is provided, the process advances to S102.

In Step 1300 (S1300: FIG. 28), the CPU 202 determines whether selection of an operation mode is started by a user operating the UI device 18 or it is automatically distinguished that the toner cartridge 52 is other than a genuine cartridge. Where it is distinguished that the toner cartridge 52 is other than a genuine cartridge, the process advances to S1308, and where a user operates the UI device 18 and starts selecting the operation mode, the process advances to S1302.

Figure 30A:
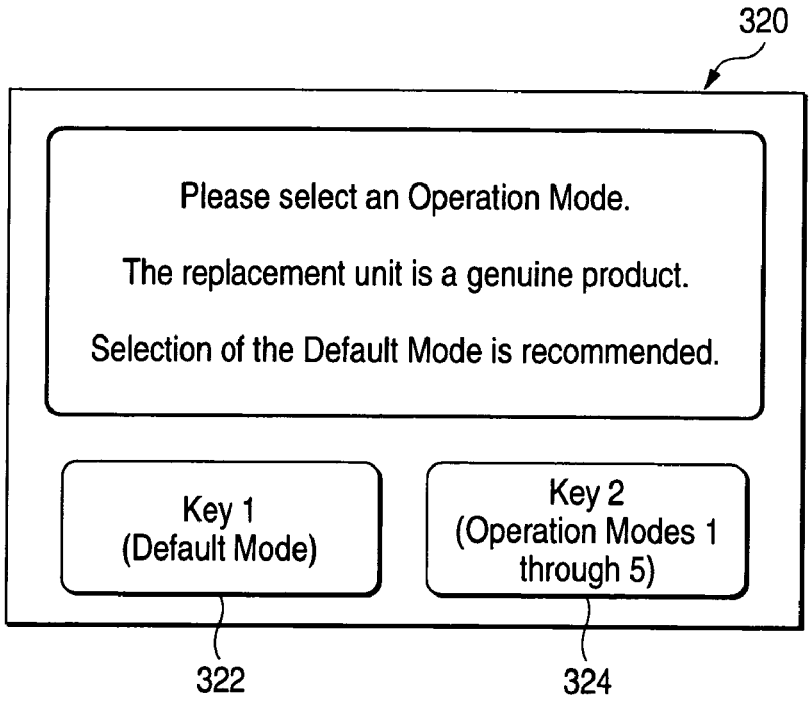
Figure 30B:
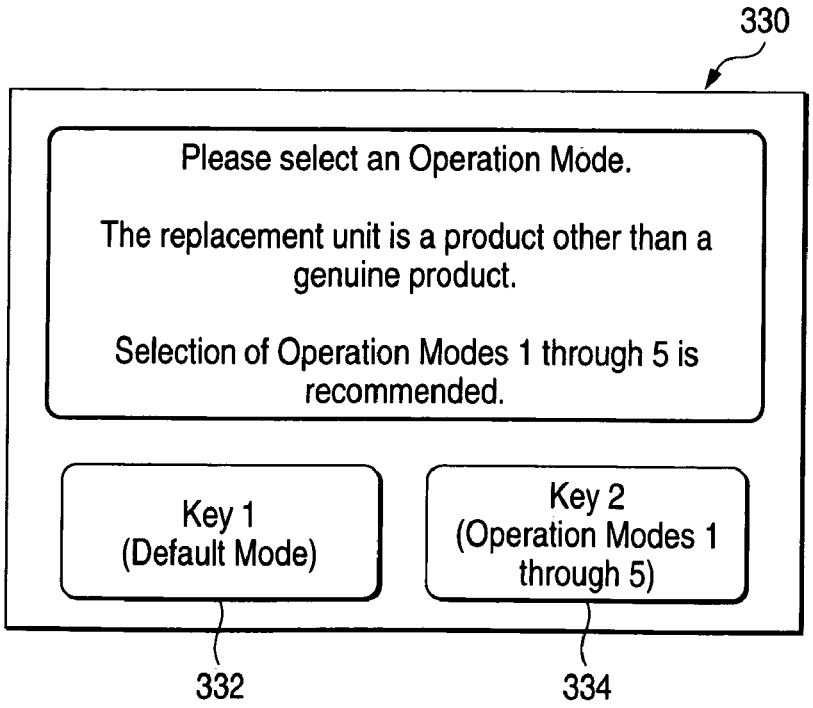

In step 1302 (S302), the UI device 18 displays an operation mode selecting screen 330, which is shown in FIG. 30B.

In Step 1304 (S1304), the CPU 202 determines whether or not an input is completed, which selects either one of the key button 332 for selecting the default mode (operation mode corresponding to a genuine product) displayed on the operation mode selection displaying screen 330 or the key button 334 for designating operation modes 1 through 5 (a plurality of other operation modes). Where an input of selecting either one of the key button 332 or 334 is completed, the process advances to S1306, and where no input of designating either one of the operation modes is provided, the process waits until a user selects an operation mode.

In Step 1306 (S1306), the CPU 202 determines whether the default mode of the operation mode selecting display screen 330 is selected or any one of the operation modes 1 through 5 is selected. Where the default mode is selected, the process advances to S1318, and where any one of the operation modes 1 through 5 is selected, the process advances to S1314. That is, where a user uses a replacement unit other than a genuine product while recognizing it as a replacement unit other than a genuine product from the beginning, in further detail, where a user selects any one of the operation modes 1 through 5 on the operation mode selecting display screen, the processes in S1308, S1310 and S1312 are not carried out.

Figure 31A:
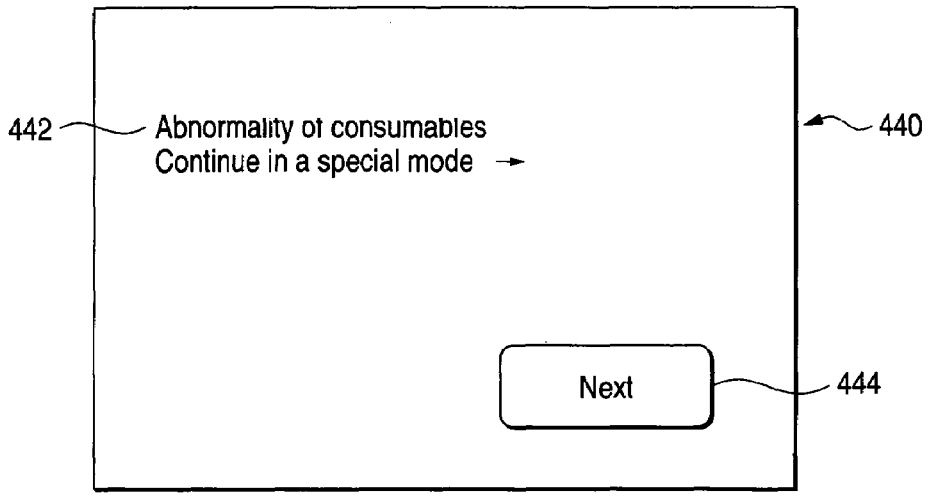

In Step 1308 (S1308), the UI device 18 displays a caution arousing screen 440 shown in FIG. 31A. The caution arousing screen 440 includes, for example, a message 442 for instructing it to a user that the mode shifts to an operation mode differing from the operation mode corresponding to a genuine product and a confirmation button 444 to be pressed when the user recognizes the instruction message 442. The CPU 202 determines whether or not the confirmation button 444 of the caution arousing screen 440 is pressed by the user. Where the confirmation button 444 is pressed, the process advances to S1310.

Figure 31B:
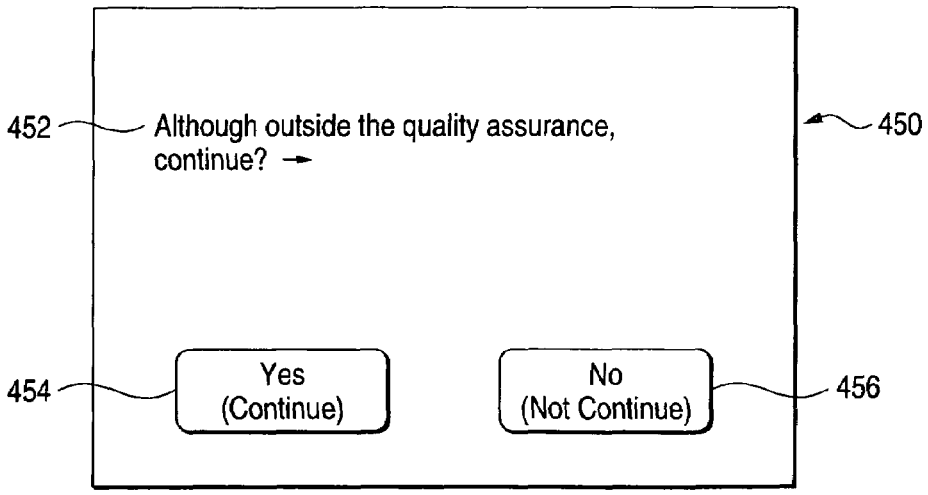

In Step 1310 (S1310), the UI device 18 displays a continuous confirmation screen 450 shown in FIG. 31B. The continuous confirmation screen 450 includes a confirmation message 452 by which a user makes sure that the same level as that of the operation mode corresponding to a genuine product cannot be guaranteed with respect to the image quality, etc., in operation modes other than the operation mode corresponding to a genuine product; a YES button 454 for shifting to an operation mode differing from the operation mode corresponding to a genuine product upon a user recognizing the cautions; and a NO button 456 for denying shift to operation modes differing from the operation mode corresponding to a genuine product.

In Step 1312 (S1312), the CPU 202 determines whether the YES button 454 or NO button 456 of the buttons displayed in the continuous confirmation screen shown in FIG. 31B is pressed. Where the YES button 454 is pressed, the process advances to S1314, and where the NO button 456 is pressed, the process advances to S118.

Figure 31C:
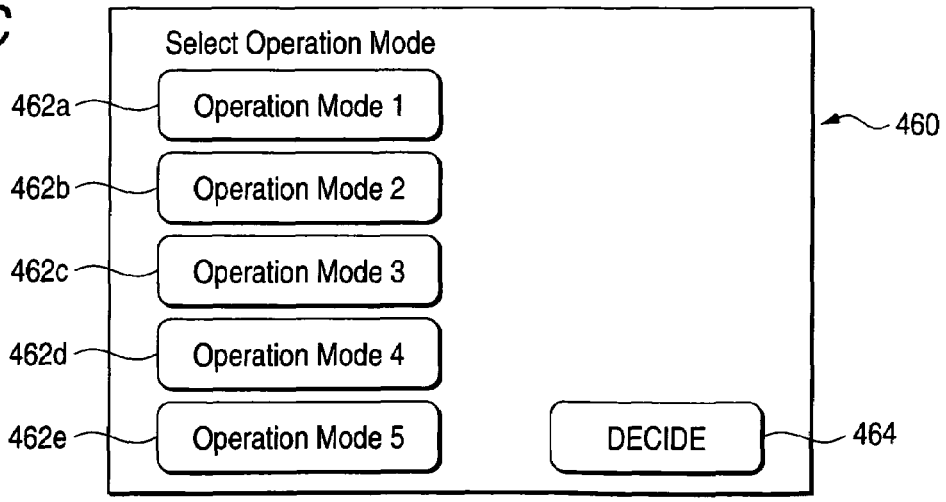
Figure 33:
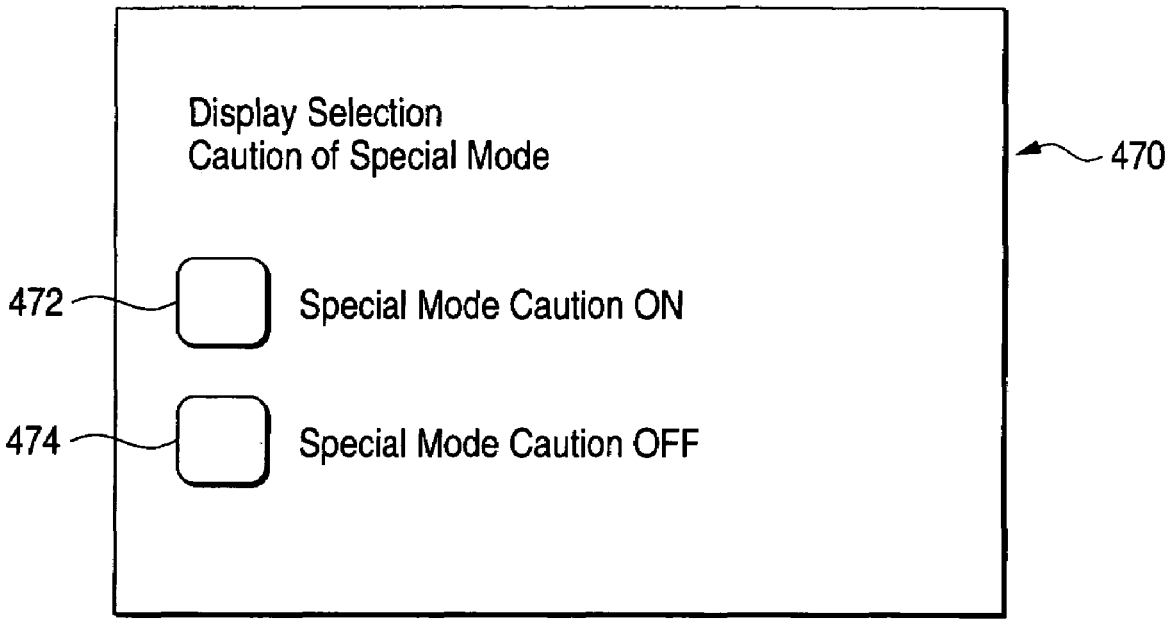
FIG. 33 is a view showing a screen displayed in the UI device in the case of accepting an input of selecting a displaying method by a user.

In Step 1314 (S1314), the UI device 18 displays an operation mode selecting screen 460 shown in FIG. 31C. The operation mode selecting screen 460 includes operation mode buttons 462*a* through 462*e* for selecting a plurality of operation modes differing from the operation mode corresponding to a genuine product and a determination button 464 for determining shift to a selected operation mode. An operation mode differing from the operation mode differing from a genuine product may not be limited to a single mode, but it may be provided in a plurality. The CPU 202 increases the display density of the button portion when a user selects either one of operation mode buttons, thereby displaying that the button is selected.

In Step 1316 (S1316), the CPU 202 determines whether or not the determination button 464 is pressed when any one of the operation modes displayed on the operation mode selecting screen 460 (a plurality of operation modes differing from the operation mode corresponding to a genuine product) is designated. Where any one of the operation modes is designated and the determination button 464 is pressed, the process advances to S1318, and where the determination button 464 is not pressed, the image forming device 10 waits until a user selects an operation mode.

In Step 1318 (S1318), the CPU 202 renews respective operation mode records 270 of the body NVM 228 to a selected operation mode (including overwriting).

In Step 400 (S400: FIG. 22), the UI device 18 displays an operation mode selecting screen 320 shown in FIG. 30A.

In Step 402 (S402), the CPU 202 determines whether or not an input of selecting either the key button 322 to select the default mode (operation mode corresponding to a genuine product) displayed on the operation mode selecting display screen 320 or the key button 324 to designate the other operation mode is completed. Where an input of selecting either the key button 322 or 324 is completed, the process advances to S404, and where no input of designating any one of operation modes is provided, the image forming device 10 waits until a user selects an operation mode.

In Step 404 (S404), the CPU 202 renews (overwrites) respective operation mode records of the body NVM 228 to the operation mode selected in S402.

In Step 118 (S118: FIG. 19), the CPU 202 carries out printing preparation in accordance with the selected operation modes included in the respective newest operation mode records, and terminates the process. Also, in S1312, where the NO button 456 is pressed, which instructs that printing is not continued outside quality assurance, the CPU 202 may control the image forming device 10 so as to stop.

Further, in the printing preparation in S118, the UI device 18 displays whether the mounted toner cartridge 52 is genuine or other than a genuine cartridge. Where the image forming device 10 is controlled in accordance with the operation mode corresponding to a genuine cartridge, the UI device 18 displays a screen shown in FIG. 32A. Where the image forming device 10 is controlled in accordance with an operation mode differing from the operation mode corresponding to a genuine cartridge, the UI device 18 displays a screen shown in FIG. 32B. At this time, as shown in FIG. 16B, the CPU 202 causes the UI device 18 to display in which mode the image forming device 10 is controlled, and information showing which replacement units are other than the operation mode corresponding to a genuine mode, in addition to a state where the image forming device 10 is ready for printing.

Where printing is carried out when the image forming device 10 is controlled in the operation mode corresponding to a genuine cartridge after the printing preparation in S118 is completed, a screen shown in FIG. 32C is displayed by, for example, a host device 2. Where printing is carried out when the image forming device 10 is controlled in an operation mode differing from the operation mode corresponding to a genuine cartridge, a screen shown in FIG. 32D is displayed as well. The CPU 202 outputs data regarding the operation mode and a replacement unit other than a genuine cartridge to the host device 2 via the network 3, wherein since the host device 2 displays information regarding the operation mode and the replacement unit other than a genuine cartridge, the image forming device 10 is able to give a user a caution of telling that the replacement unit mounted at the present is other than a genuine cartridge.

Further, where an input for commencing selection of display modes is provided by a user operating the UI device 18, in Step 1500 (S1500: FIG. 29), the UI device 18 displays a display selection screen 470 including a display available button 472 for a user to select that an additional message shown in FIG. 32B and FIG. 32D is displayed where the image forming device 10 is controlled in an operation mode differing from the operation mode corresponding to a genuine cartridge, and a display-free button 474 for a user to select that the additional message is not displayed where the image forming device 10 is controlled in an operation mode differing from the operation mode corresponding to a genuine cartridge.

In Step 1502 (S1502), the CPU 202 determines whether or not the display-available button 472 or display-free button 474, which is displayed in the display selection screen 470, is pressed. Where any one of the buttons is pressed, the process advances to S1504, and where no input of designating either display method is provided, the image forming device 10 waits until a user selects a display method.

In Step 1504 (S1504), when the display-available button 472 is pressed on the display selection screen 470, the CPU 202 changes a display method so that the additional message is displayed in the UI device 18 as shown in FIG. 32B and FIG. 32D wherein the image forming device 10 is controlled in an operation mode differing from the operation mode corresponding to a genuine cartridge. Also, when the display-free button 474 is pressed on the display selection screen 470, the CPU 202 changes the display method so that the additional message is not displayed as shown in FIG. 32A and FIG. 32C even where the image forming device 10 is controlled in an operation mode differing from the operation mode corresponding to a genuine cartridge.

Thus, by a user selecting an operation mode differing from the operation mode corresponding to a genuine cartridge even if a replaceable unit of the image forming device 10 is other than a genuine cartridge, it becomes possible to improve the image quality.

Further, where all the replaceable units are genuine, the operation mode which can be selected by a user is limited so that the image forming device 10 is actuated only in the operation mode corresponding to a genuine cartridge, thereby preventing the image quality from deteriorating due to an erroneous operation of a user.

Further, where a replacement unit other than a genuine cartridge is mounted, the image forming device 10 displays that a replacement unit other than a genuine cartridge is mounted, thereby causing a user to correctly recognize the replacement unit.

Next, a description is given of a modified version of an image forming device according to an embodiment of the invention. In the modified version of the image forming device, guidance information display is given to the host device 2, and an operation mode change request can be accepted from the host device 2.

A web server (also called a WWW server or http server) is further included in a program domain 234 which the image forming device 10 holds. The web server is to communicate with the host device 2 by means of http (HyperText Transfer Protocol).

FIG. 17 is a view showing a hardware configuration of the host device 2 shown in FIG. 1.

As shown in FIG. 17, the host device 2 comprises a unit 400 including a CPU 402 and a memory 404, a display/input unit 410 including a liquid crystal display, keyboard and mouse (not illustrated), a recording device 408 such as a HDD/CD unit, and a communication unit 406 for carrying out communications between the same host device 2 and a network. That is, the host device 2 includes a structure portion operating as a general computer capable of communicating via a network.

FIG. 18 is a view showing a configuration of a client program 420 operating in the host device 2 shown in FIG. 1.

As shown in FIG. 18, the client program 420 includes a user interface (UI portion) 422, a printer driver 424, a web browser 426 and a network communication portion 428.

The client program 420 is given to the recording device 408 of the host device 2 via, for example, a recording medium 412 and is loaded in the memory 404 and is executed. The client program 420 provides a status inspecting feature and a setting changing feature of the image forming device 10 to a user who utilizes the host device 2, and displays messages sent from the image forming device 10 via the network 3.

In the client program 420, the UI portion 422 accepts operations carried out by a user with respect to the display/input unit 410 and controls the processes of respective configurational portions of the client program 420. Also, the UI portion 322 displays the data, which the printer driver 424 and web browser 426 receives via the network 3, to a user.

The printer driver 424 provides a status inspecting feature and a setting changing feature of the image forming device 10 to a user of the host device 2. In addition, the printer driver 424 provides a message notifying feature from the image forming device 10. The client program 420 may include a utility program having a feature equivalent to the printer driver 424. The utility program is not specified to a specified image forming device. It has a status inspecting feature and a setting changing feature of a device connected to the network.

The web browser 426 provides a status inspecting feature and a setting changing feature of the image forming device 10 to a user of the host device 2 via the web server operating in the image forming device 10.

The network communication control portion 428 controls communications with the image forming device 10 connected via the network 3 shown in FIG. 1.

Figure 34:
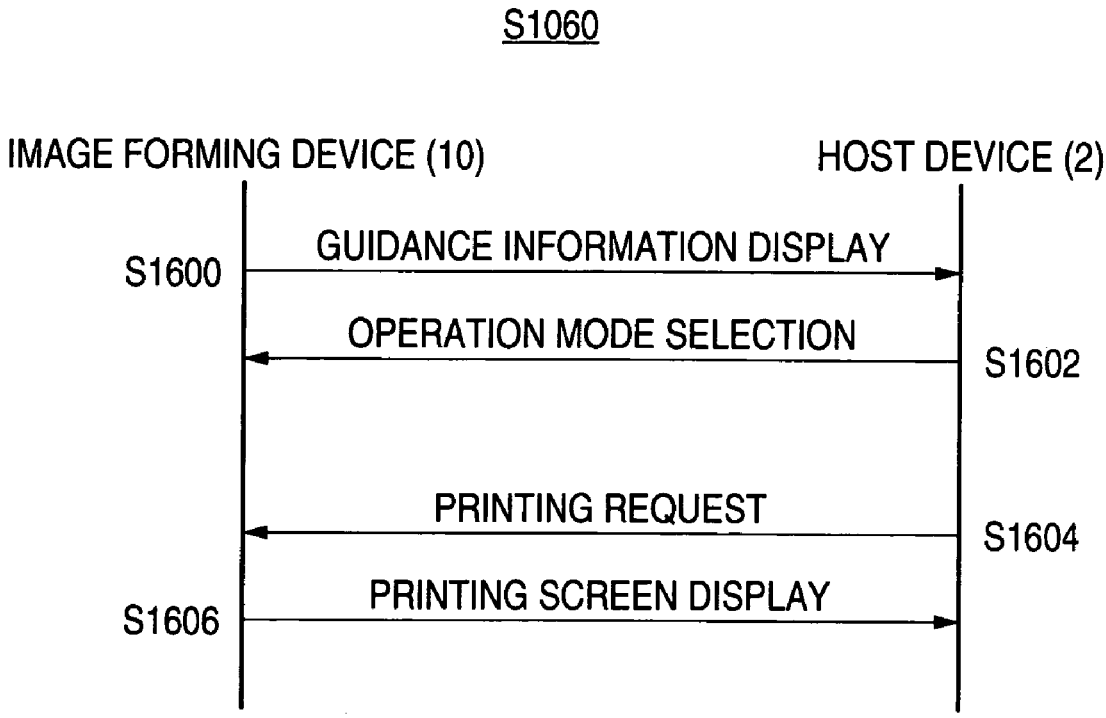
FIG. 34 is a communication sequence diagram showing operations between the image forming device and host device.

FIG. 34 is a communication sequence view (S1060) showing actions between the image forming device 10 and the host device 2.

As shown in FIG. 34, in Step 1600 (S1600), the CPU 202 outputs data regarding the caution arousing screen 440 shown in FIG. 31A to the host device 2 where it is determined that the replaced toner cartridge 52 is other than a genuine cartridge, and commences guidance information display. In the host device 2, the client program 420 receives data, and the caution arousing screen 440 is displayed in the display/input unit 410. After the caution arousing screen 440 is displayed, a guidance information displaying process equivalent to the process shown in S1030 is carried out between the image forming device 10 and the host device 2.

In Step 1602 (S1602), a user selects an operation mode using the display/input unit 410 of the host device 2, and the host device 2 outputs data regarding the selected operation mode to the image forming device 10. The CPU 202 of the image forming device 10 is able to control the image forming device 10 in the selected operation mode on the basis of the data received from the host device 2.

In Step 1604 (S1604), the user issues a printing request to the image forming device 10 using the display/input unit 410 of the host device 2.

In Step 1606 (S1606), the image forming device outputs data regarding the screen shown in FIG. 32C and FIG. 32D to the host device 2, and the host device 2 displays the screen in the display/input unit 410.

Thus, the user confirms messages displayed in the display/input unit 410 of the host device 2, and is able to recognize that a toner cartridge 52 other than a genuine cartridge is mounted in the image forming device 10. Further, using the display/input unit 410, the user is able to select one operation mode from a plurality of operation modes differing from the operation mode corresponding to a genuine cartridge.

In addition, using the web browser 426, the user may change the operation mode in the screen equivalent thereto, and may change the display method. In this case, by a user changing the operation mode, the image forming device 10 will be controlled in an operation mode brought about after the change.

What is claimed is:

1. An image forming device, comprising:

a main device body;

at least one replacement unit replaceably mounted in the main device body;

a determining unit for determining whether the replacement unit is genuine or other than a genuine product;

an inputting unit for selecting a first operation mode corresponding to a genuine replacement unit and other operation modes differing from the first operation mode;

a controlling unit for controlling image formation in the operation mode selected by the inputting unit;

a displaying unit for displaying information regarding a usage amount of the replacement unit; and a display controlling unit for controlling a display pattern of the information regarding the usage amount displayed by the displaying unit in accordance with results of determination made by the determining unit.

2. The image forming device according to claim 1, wherein the display controlling unit stops displaying the information regarding the usage amount of the replacement unit by the displaying unit when the determining unit determines that the replacement unit is other than a genuine product.

3. The image forming device according to claim 1, wherein the displaying unit displays the information regarding the usage amount measured or metered since the replacement unit is mounted, when the determining unit determines that the replacement unit is other than a genuine product.

4. The image forming device according to claim 1, wherein the display controlling unit selects a display pattern from a plurality of display patterns.

5. An image forming device, comprising:

a main device body;

at least one replacement unit replaceably mounted in the main device body;

a detecting unit for detecting that the replacement unit has been replaced;

a determining unit for determining whether the replacement unit is genuine or other than a genuine product when the detecting unit detects that the replacement unit has been replaced;

an inputting unit for selecting a first operation mode corresponding to a genuine replacement unit and other operation modes differing from the first operation mode;

a controlling unit for carrying out control in the operation mode selected by the inputting unit;

a displaying unit for displaying information regarding a usage amount of the replacement unit; and a display controlling unit for changing a display pattern of the information regarding the usage amount displayed by the displaying unit in accordance with results of determination made by the determining unit.

6. An image forming system, comprising:

an image forming device; and a host device connected to the image forming device;

wherein the image forming device includes:

a main device body;

at least one replacement unit replaceably mounted in the main device body;

a determining unit for determining whether the replacement unit is genuine or other than a genuine product;

a controlling unit for carrying out control in an operation mode selected by the inputting unit;

a display controlling unit for changing a display pattern of information regarding a usage amount of a displaying unit in accordance with results of determination made by the determining unit; and wherein the host device includes:

an inputting unit for selecting a first operation mode corresponding to a genuine replacement unit and other operation modes differing from the first operation mode; and the displaying unit for displaying information regarding the usage amount of the replacement unit.

7. An image forming device, comprising:

a main device body;

at least one replacement unit which is replaceably mounted in the main device body;

a determining unit for determining whether the replacement unit is genuine or other than a genuine product;

a displaying unit for displaying guidance information when the determining unit determines that the replacement unit is other than a genuine product;

an inputting unit for allowing a user to select from among a first operation mode corresponding to the replacement unit which is genuine and another mode differing from the first operation mode, after the determination by the determining unit; and a controlling unit for carrying out control in the operation mode selected by the inputting unit.

8. The image forming device according to claim 7, wherein the displaying unit displays that the replacement unit is other than a genuine product, when the determining unit determines that the replacement unit is other than a genuine product.

9. The image forming device according to claim 7, wherein when the determining unit determines that the replacement unit is other than a genuine product, the displaying unit displays that the controlling unit operates in another mode differing from the first operation mode.

10. The image forming device according to claim 7, wherein where the controlling unit operates in other operation modes differing from the first operation mode, the displaying unit displays that at least one of the image quality and performance deteriorates in comparison with a case of operation in the first mode.

11. The image forming device according to claim 7, wherein the displaying unit displays that the controlling unit controls in other operation modes differing from the first operation mode.

12. The image forming device according to claim 7, wherein where the controlling unit controls in another mode differing from the first operation mode, the displaying unit displays that the replacement unit is determined to be other than a genuine product.

13. The image forming device according to claim 11, wherein the inputting unit includes a display/non-display selecting unit for selecting whether the displaying unit is caused to operate.

14. The image forming device according to claim 7, wherein an operation mode corresponding to a replacement unit which is genuine is set as a default.

15. An image forming device, comprising:

a main device body;

at least one replacement unit which is replaceably mounted in the main device body;

a detecting unit for detecting that the replacement unit is replaced;

a determining unit for determining whether the replacement unit is genuine or other than a genuine product when the detecting unit detects that a replacement unit is replaced;

a displaying unit for displaying guidance information when the determining unit determines that the replacement unit is other than a genuine product;

an inputting unit for allowing a user to select from among an operation mode corresponding to a replacement unit which is genuine and other operation modes differing from the first operation mode, after the determination by the determining unit; and a controlling unit for carrying out control in the operation mode selected by the inputting unit.

16. The image forming device according to claim 15, wherein the inputting unit is capable of selecting an operation mode where no replacement unit is detected by the detecting unit.

17. The image forming device according to claim 15, wherein where the detecting unit detects that a replacement unit is replaced, the determining unit determines whether the replacement unit is genuine or other than a genuine product.

18. The image forming device according to claim 15, wherein after the detecting unit detects that a replacement unit is replaced, the determining unit determines whether the replacement unit is genuine or other than a genuine product.

19. An image forming system comprising an image forming device and a host device connected to the image forming device;

wherein the image forming device includes:

a main device body;

at least one replacement unit which is replaceably mounted in the main device body;

a determining unit for determining whether the replacement unit is genuine or other than a genuine product; and a controlling unit for carrying out control in an operation mode selected by an inputting unit; and wherein the host device includes:

a displaying unit for displaying guidance information where it is determined on the basis of determination made by the determining unit that the replacement unit is other than a genuine product; and the inputting unit for allowing a user to select from among an operation mode corresponding to a replacement unit which is genuine or other operation modes differing from the first operation mode, after the determination by the determining unit.

20. The image forming device according to claim 8, wherein where the controlling unit operates in other operation modes differing from the first operation mode, the displaying unit displays that at least one of the image quality and performance deteriorates in comparison with a case of operation in the first mode.

21. The image forming device according to claim 9, wherein where the controlling unit operates in other operation modes differing from the first operation mode, the displaying unit displays that at least one of the image quality and performance deteriorates in comparison with a case of operation in the first mode.

22. The image forming device according to claim 12, wherein the inputting unit includes a display/non-display selecting unit for selecting whether the displaying unit is caused to operate.

* * * * *